US009092934B2

(12) United States Patent
Graham et al.

(10) Patent No.: US 9,092,934 B2
(45) Date of Patent: Jul. 28, 2015

(54) RECOVERY OF GRAPHICAL GAME HISTORY AFTER GAME SOFTWARE PACKAGE HAS BEEN REMOVED FROM ELECTRONIC GAMING MACHINE

(75) Inventors: Jacob T. Graham, Sparks, NV (US); Paul W. Bolton, Reno, NV (US); Dwayne R. Nelson, Las Vegas, NV (US); Rex Y. Lam, Reno, NV (US); Steven G. LeMay, Reno, NV (US); Warner R. Cockerille, IV, Sparks, NV (US); William R. Brosnan, Reno, NV (US); Xuedong Chen, Reno, NV (US); Sean M. Gilliland, Reno, NV (US)

(73) Assignee: IGT, Las Vegas, NV (US)

( * ) Notice: Subject to any disclaimer, the term of this patent is extended or adjusted under 35 U.S.C. 154(b) by 294 days.

(21) Appl. No.: 13/334,437

(22) Filed: Dec. 22, 2011

(65) Prior Publication Data

US 2013/0165211 A1 Jun. 27, 2013

(51) Int. Cl.
*G07F 17/32* (2006.01)

(52) U.S. Cl.
CPC ..... *G07F 17/3227* (2013.01); *G07F 17/3237* (2013.01); *G07F 17/3241* (2013.01); *G07F 17/32* (2013.01)

(58) Field of Classification Search
USPC ..... 463/43
See application file for complete search history.

(56) References Cited

U.S. PATENT DOCUMENTS

| | | | | |
|---|---|---|---|---|
| 6,863,608 | B1 * | 3/2005 | LeMay et al. | 463/24 |
| 6,918,831 | B2 * | 7/2005 | Nguyen et al. | 463/20 |
| 7,322,887 | B2 * | 1/2008 | Belger et al. | 463/20 |
| 7,384,339 | B2 * | 6/2008 | LeMay et al. | 463/30 |
| 7,951,008 | B2 * | 5/2011 | Wolf et al. | 463/43 |
| 7,993,195 | B2 * | 8/2011 | Belger et al. | 463/20 |
| 8,206,215 | B2 * | 6/2012 | Moyle et al. | 463/29 |
| 8,257,163 | B2 * | 9/2012 | Belger et al. | 463/20 |
| 2004/0147314 | A1 * | 7/2004 | LeMay et al. | 463/30 |
| 2006/0252534 | A1 * | 11/2006 | Walker et al. | 463/31 |
| 2007/0207854 | A1 * | 9/2007 | Wolf et al. | 463/29 |
| 2008/0076546 | A1 * | 3/2008 | Moyle et al. | 463/29 |
| 2011/0151966 | A1 * | 6/2011 | Hawkins | 463/25 |
| 2012/0142429 | A1 * | 6/2012 | Muller | 463/42 |
| 2013/0012310 | A1 * | 1/2013 | Shepard et al. | 463/29 |

OTHER PUBLICATIONS

URL (Uniform Resource Locator) Definition, TechTerms.com at 1 (Dec. 1, 2006) (available at http://www.techterms.com/definition/url) ("URL").*

* cited by examiner

*Primary Examiner* — Bach Hoang
(74) *Attorney, Agent, or Firm* — Neal, Gerber & Eisenberg LLP

(57) ABSTRACT

Disclosed herein are techniques and equipment for saving game history data and package identification information for software packages used to provide a game cycle on a wager gaming machine. The game cycle may later be re-created using the game history data and software packages. For scenarios where some or all of the software packages used are no longer present on the gaming machine at the time of re-creation, the package identification information may be referenced to determine which software packages are missing and need to be provided to enable full game cycle re-creation.

27 Claims, 13 Drawing Sheets

GC = Game Play Cycle

†Installed packages as of 3:04:30 PM.

RECOVERY OF GRAPHICAL GAME HISTORY AFTER GAME SOFTWARE PACKAGE HAS BEEN REMOVED FROM ELECTRONIC GAMING MACHINE

TECHNICAL FIELD

The present disclosure relates generally to wager-based gaming machines and systems, and more specifically to game history re-creation for such gaming machines and systems.

BACKGROUND

Entities offering wager gaming may wish to track a gaming machine's play history and to recover or re-create aspects of past-played games based on the tracked play history. For example, a wager gaming machine offering video slot machine play may save a screen capture of each game play provided by the wager gaming machine. The screen captures may later be referenced to determine what game outcome was displayed on the gaming machine for various game plays. Some gaming machines may save multiple screen captures during a game play to capture various stages of play during the game play, such as initial wager, additional wagers, initial draws, additional draws, etc.

SUMMARY

In some implementations, a method for processing game cycles on a wager gaming machine for later game cycle re-creation may be provided. The method may include providing, by the wager gaming machine and using one or more software packages available on the wager gaming machine, one or more game cycles; storing in a memory, for each provided game cycle, package identification information indicating the one or more software packages used by the wager gaming machine to provide the game cycle; and storing in the memory, for each provided game cycle, game history data associated with the package identification information for the game cycle, the game history data including data produced by the one or more software packages and defining an outcome of the game cycle. Each game cycle may represent a single game play of a wagering game.

For example, at least one of the one or more game cycles may be for a poker game and each of the at least one game cycles for the poker game may include dealing an initial card hand, one or more rounds of bets, and a determination of one or more winning card hands. In some implementations, each game cycle may include an initial wager and a game outcome determination associated with the initial wager; at the close of the game cycle, a player of the cycle may be presented with an opportunity to cash out. In some implementations, at least one of the one or more game cycles may be for a slot machine game and each of the at least one game cycles for the slot machine game may include an initial wager, a reel-spin, and a determination of at least one pay line outcome.

In some further implementations, the method may include receiving a request that a past game cycle be re-created on the wager gaming machine; determining, responsive to receiving the request, that at least some of the one or more software packages indicated by the package identification information associated with the past game cycle are presently unavailable on the wager gaming machine; transferring the one or more presently unavailable software packages to the wager gaming machine from a source other than the wager gaming machine; and re-creating the past game cycle using, at least in part, the transferred one or more software packages and the game history data.

In some implementations, a method for processing game cycles on a wager gaming machine may be provided. The method may include providing, by the wager gaming machine, one or more games of chance for play. The method may further include providing, by the wager gaming machine and using one or more software packages available on the wager gaming machine, one or more game cycles of the one or more games of chance provided by the wager gaming machine. The method may also include determining, by the wager gaming machine and for each game cycle provided by the wager gaming machine, game history data for the game cycle and package identification information indicating one or more of the one or more software packages used to provide the game cycle. The method may additionally include storing in a memory, for each game cycle provided by the wager gaming machine, the game history data determined for the provided game cycle and the package identification information determined for the provided game cycle, wherein the game history data for the provided game cycle is associated with the package identification information for the provided game cycle.

In some implementations, the game history data may at least include game re-creation data produced by the one or more software packages and wherein the game history data also defines at least one outcome of the game cycle. In some implementations, each game cycle may represent a single game play of a wagering game. For example, in some implementations, at least one of the one or more game cycles may be for a poker game and each of the at least one game cycles for the poker game may include dealing an initial card hand, one or more rounds of bets, and a determination of one or more winning card hands. By way of further example, in some implementations, at least one of the one or more game cycles may be for a slot machine game and each of the at least one game cycles for the slot machine game may include an initial wager, a reel-spin, and a determination of at least one pay line outcome.

Some implementations of the method may also include receiving an indication of a particular game cycle of the one or more game cycles provided by the wager gaming machine and retrieving the stored game history data and associated package identification information for the particular game cycle from the memory.

Some further implementations of the method may include determining, responsive to retrieving the package identification information, that the one or more software packages indicated by the retrieved package identification information are presently available on the wager gaming machine and re-creating the particular game cycle in graphical form on the wager gaming machine using the retrieved game history data in conjunction with the one or more software packages indicated by the package identification information.

In some other further implementations, the method may include determining, responsive to retrieving the package identification information, that at least one of the one or more software packages indicated by the retrieved package identification information is presently unavailable on the wager gaming machine; displaying at least some of the retrieved game history data in textual form; and displaying an indication of the retrieved package identification information in textual form.

In some implementations, the displayed indication of the package identification information may indicate the at least one of the one or more software packages indicated by the package identification information that are presently unavailable on the wager gaming machine and may not indicate any software packages indicated by the package identification information that are presently available on the wager gaming machine.

In some further implementations, the method may include receiving an input indicating that the retrieved game history data for the particular game cycle is to be re-created in graphical form; transferring the at least one of the one or more software packages presently unavailable on the wager gaming machine to the wager gaming machine from at least one second memory; and re-creating the particular game cycle in graphical form on the wager gaming machine using the retrieved game history data in conjunction with the one or more software packages indicated by the retrieved package identification information.

In some implementations, the package identification information may include a file name. In some other implementations, the package identification information may include a package name and a version. In yet other implementations, the package identification information may include a pointer to a particular record in an external database, wherein the particular record in the external database uniquely identifies a particular software package of the at least one of the one or more software packages currently unavailable on the wager gaming machine. In some further implementations, the particular record in the external database may also provide a pointer to a memory location in the at least one second memory where the particular software package is stored.

In some implementations, the at least one second memory may be a removable memory device temporarily communicatively connected with the wager gaming machine for the purposes of game cycle re-creation. In some other implementations, the wager gaming machine may be configured to communicate with a gaming server over a gaming network and the at least one second memory may be located in the gaming server. In yet other implementations, the wager gaming machine may be configured to communicate with multiple second wager gaming machines over a gaming network, the at least one second memory may be distributed across the multiple second wager gaming machines, and the transferred one or more software packages may be transferred from the second wager gaming machines to the wager gaming machine using a peer-to-peer protocol.

In some implementations, a method of processing game cycles on a wager gaming machine is provided. The method may include mounting, on a storage system of the wager gaming machine, one or more software packages for providing wagering games and inspecting, by the wager gaming machine, metadata associated with each software package mounted on the storage system. The method may also include determining, by the wager gaming machine and as part of the inspecting: one or more wagering games to be provided by the wager gaming machine based on the mounted software packages, and, for each wagering game to be provided by the wager gaming machine, package identification information for any of the one or more software packages required to provide the wagering game on the wager gaming machine. The method may further include storing, in a registry in memory and for each wagering game to be provided by the wager gaming machine, the package identification information of the software package or software packages required to provide the wagering game on the wager gaming machine; receiving a request to play one or more game cycles for a selected wagering game of the one or more wagering games; providing the requested game cycles for play on the wager gaming machine; and storing, for each requested game cycle and in a second memory: game history data for the game cycle, and the package identification information for the software package or software packages required to provide the requested game cycle for the selected wagering game.

In some further implementations, the method may include receiving a request to re-create a particular game cycle of the one or more game cycles after the particular game cycle has been provided for play and retrieving the stored game history data for the particular game cycle and the stored package identification information for the particular game cycle from the second memory.

In some implementation, the method may also further include determining, by the wager gaming machine and by referencing the registry, that the software package or software packages indicated by the retrieved package identification information are mounted on the storage system for the wager gaming machine at the time the request is received and re-creating the particular game cycle in graphical form on the wager gaming machine using the retrieved stored game history data in conjunction with the software package or software packages indicated by the retrieved stored package identification information.

In some other implementations, the method may also further include (a) unmounting one or more of the one or more software packages mounted on the storage system of the wager gaming machine and (b) re-inspecting, by the wager gaming machine, metadata associated with each software package mounted on the storage system. The method may further include (c) re-determining, by the wager gaming machine and as part of the re-inspecting: one or more wagering games to be provided by the wager gaming machine based on the mounted software packages, and, for each wagering game to be provided by the wager gaming machine, package identification information for any of the one or more software packages required to provide the wagering game on the wager gaming machine. The method may also include (d) updating the registry to indicate that the unmounted software packages are unavailable and (e) determining, by the wager gaming machine and by referencing the registry, that at least one of the one or more software packages indicated by the retrieved package identification information is presently unavailable on the wager gaming machine. The method may additionally include (f) displaying at least some of the retrieved game history data in textual form; and (g) displaying an indication of the retrieved package identification information in textual form, wherein (a)-(d) are performed prior to receiving the request to re-create the particular game cycle, and (e)-(g) are performed after receiving the request to re-create the particular game cycle.

In some implementations of the method, the indication of the package identification information may indicate the at least one of the one or more software packages indicated by the retrieved package identification information that are unavailable on the wager gaming machine and may not indicate any of the software packages indicated by the retrieved package identification information that are available on the wager gaming machine.

In some implementations of the method, the method may include receiving an input indicating that the retrieved game history data for the particular game cycle is to be re-created in graphical form; transferring the at least one of the one or more software packages indicated by the retrieved package identification information that are unavailable on the wager gaming machine to the wager gaming machine from a third memory; mounting the transferred one or more software packages to the storage system; and re-creating the particular game cycle in graphical form on the wager gaming machine using the retrieved game history data in conjunction with the software package or software packages indicated by the retrieved package identification information.

In some implementations of the method, the package identification information may include a file name. In some other implementations of the method, the package identification information may include a package name and a version. In yet other implementations of the method, the package identification information may include a pointer to a particular record in an external database, wherein the particular record in the external database uniquely identifies a particular software package of the at least one of the one or more software packages currently unavailable on the wager gaming machine. The particular record in the external database may also provide a pointer to a memory location where the particular software package is stored.

Details of one or more implementations of the subject matter described in this specification are set forth in the accompanying drawings and the description below. Other features, aspects, and advantages will become apparent from the description, the drawings, and the claims. Note that the relative dimensions of the following figures may not be drawn to scale.

BRIEF DESCRIPTION OF THE DRAWINGS

The included drawings are for illustrative purposes and serve only to provide examples of possible structures and process steps for the disclosed inventive systems, methods, and apparatuses for providing multi-currency progressive jackpots for wagering game play. These drawings in no way limit any changes in form and detail that may be made to implementations by one skilled in the art without departing from the spirit and scope of the disclosure.

DETAILED DESCRIPTION

Figure 1:
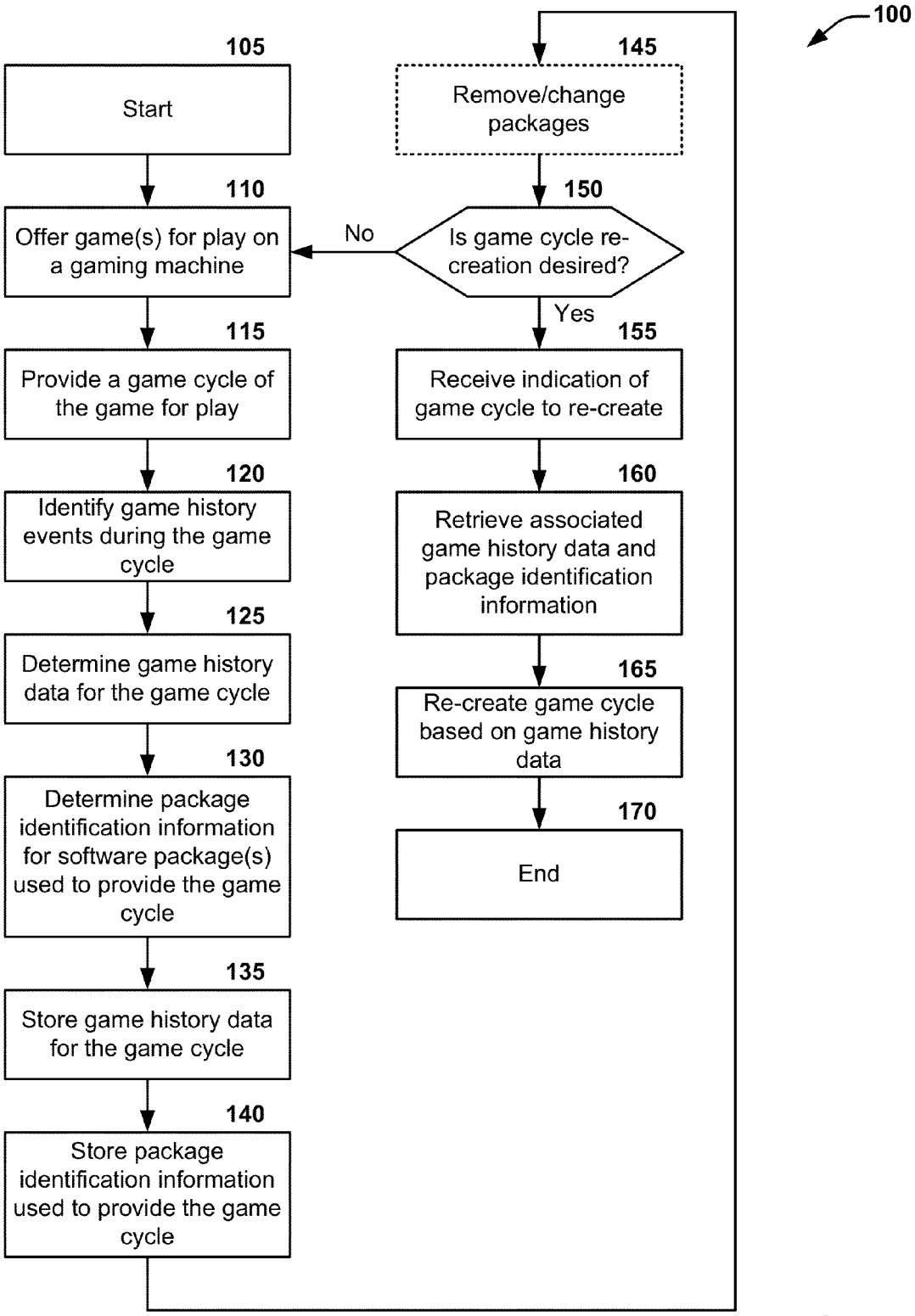
FIG. 1 shows a block diagram of one example of a technique for providing game cycle re-creation.

The following text sets forth a detailed description of numerous different embodiments. The detailed description is to be construed as an example only and does not describe every possible embodiment. Numerous alternative embodiments may be implemented, using either current technology or technology developed after the filing date of this patent that would still fall within the scope of the claims.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

A game cycle, as used herein, refers to a single play of a wagering game. For example, a game cycle for a poker game may include an initial deal of an initial hand, the initial ante, the flop, and any additional betting which may occur before a new game cycle is initiated. Such a poker game cycle may end when no further betting occurs, and a winner is determined. The next initial hand dealt may initiate another game cycle. A game cycle may also include the play of another game or games, such as bonus games, which may be triggered during the game cycle. In some circumstances, it may be desirable to retrieve and re-create aspects of a particular game cycle for later review. This may be done, for example, in cases where a game outcome is in dispute, or for regulatory reasons. Generally speaking, a game cycle may begin with a wager in some form, e.g., a player's money or from an external source, followed by an evaluation or determination, and ending with an award. The award may, for example, be a multiple of the initial wager, although the award may also, in some cases, be a fraction of the initial wager or may even be a zero amount. In general, if a player has sufficient credit to make a further initial wager after the award, a new game cycle may be initiated.

Game cycles for a wagering game may be provided by executing software for the wagering game. The software may be provided to a wagering machine in the form of software packages, which are collections of data objects or code which are grouped together, usually according to some common relationship. For example, the grouping may be because data objects or code are logically related, e.g., they may all be used to provide aspects of a particular software program, such as a particular wagering game. Each software package may contain assets such as graphics objects, sound and music data, computer-executable instructions, pay table information, etc. Some software packages may contain only a subset of such assets. In some implementations, a software package may, for example, contain computer-executable instructions which modify or supersede the execution of computer-executable instructions in other software packages. A software package may be a single file, or may be multiple files which are grouped together. Software packages may be encrypted or otherwise secured against use unless a corresponding certificate is provided which allows the software package to be used. In some implementations, the software package may, strictly speaking, be useable without an accompanying certificate, but the operating system of the gaming machine may refuse to load or execute the software package unless the certificate is present. The certificate may allow the integrity of the software package to be verified by a gaming machine prior to use to forestall the possibility of software package damage or tampering.

FIG. 1 depicts a flowchart for one implementation of one technique 100 for providing for game cycle re-creation on a gaming machine after gaming software packages have been removed. The technique begins in block 105.

In block 110, one or more main games are offered for play on a gaming machine. Some gaming machines may allow players to play only one main game, whereas other gaming machines may allow players to select from two or more offered main games. The technique may be used with either type of gaming machine. In block 115, a game cycle for the game, or one of the games in the case of a multi-game gaming machine, is provided for play.

In block 120, various game history events may be identified during the game cycle of block 115. Such game history events may include wagering events such as an initial wager or additional wager or wagers, etc. Game history events may also include events such as player inputs, e.g., a player's choices as to which cards to discard in some poker games, a player's choice to be "hit" during blackjack, etc. Game history events may also include other events which may be useful for re-creating the game cycle, such as the occurrence of the flop during a poker game. Some such events may define a "step" in a game cycle. For example, in a poker game cycle, there may be a step for the initial draw, a step for the initial bet, steps for each other player's initial bet, steps for each of the players' pre-flop bets, a step for the flop, and steps for each of the players' post-flop bets. In such a poker example, there may be a varying number of steps per game cycle, depending on the actions of the players. In game cycles for other types of game, there may be a fixed number of steps per game cycle. A step may, in general, represent a point where a decision is made which affects the final outcome or the display of the game. The decision may be made based on player input, e.g., the player selecting a game option, or based on a non-player-generated input, e.g., a random number event. For example, a player may be presented with the option to select a number from a set of numbers to determine how many free spins of a gaming wheel they will receive in a following free-spin bonus. The selection of the number may be considered to be a step. If the player subsequently uses the free spins during the gaming cycle, each such free spin may be considered to be an additional step within the game cycle. If the game randomly determines an outcome for each such free spin, each such random outcome determination may also be considered to be a step.

In block 125, game history data may be determined for the game cycle. Such game history data may be determined in response to one or more game history events and may include, for example, data regarding the amount wagered, the amount won, the credit meter balance, the random number or numbers used to determine the game outcome or outcomes for the game cycle, identification of cards dealt, identification of slot symbols displayed, player identification data, player image data, player biometric data, etc. Game history data may be recorded at multiple times during a single game cycle, e.g., during each of a plurality of game cycle steps, and different types of game history data may be recorded during different steps for a single game cycle. For example, game history data may be recorded during each step of a game cycle. Some game history data may be expressed in textual form to a later reviewer without any loss in fidelity, e.g., meter amounts may be displayed in text form to a viewer and be completely understandable to the viewer in textual form.

The game history data may also include data specific to the gaming routines used to provide the game cycle, e.g., game re-creation data created by the software packages used to provide the game cycle. Such game re-creation data may include data pertaining to the game during various steps, such as data needed to re-create the initial hand draw of a poker game, the initial antes, the flop draw, etc. Such game re-creation data may include machine-readable files which do not, in isolation, reveal practically useful information about the game cycle. However, such game re-creation data may be accessed by the software package or software packages originally used to provide the game cycle in order to graphically re-create the game cycle. Such game re-creation data may, for example, include pointers to graphics assets displayed by the game during the game cycle, as well as information describing how those graphics assets were manipulated during the game cycle. Game re-creation data may also or alternatively include other data which may be used in conjunction with software packages in order to graphically re-create a game cycle.

In block 130, package identification information for the software package or software packages used to provide the game cycle may be determined. As noted above, wagering game software may be provided to a gaming machine as one or more software packages. The package identification information uniquely identifies the software package or software packages used to provide a particular game cycle. Package identification information may include information which uniquely identifies the particular software package with which it is associated. Package identification information may include, for example, a filename of the software package or a unique pointer to a database record which contains, for example, a file name of the software package or a memory location where the software package may be found.

For example, in some wagering game implementations, core wagering game functionality may be provided by software package A, which contains computer-executable instructions. A variety of other software packages may exist, however, which may be used with software package A to provide different implementations of the core wagering game functionality. For example, software package B may include a set of animal-themed graphics objects which may be used with software package A to provide an animal-themed wagering game. Software package C may include a set of Egyptian-themed graphics objects which may be used with software package A to provide an Egyptian-themed wagering game. If game history data for a game cycle for the Egyptian-themed wagering game is produced, package identification information identifying software packages A and C would be determined.

A gaming machine may have software packages installed which are not used or required to provide the game cycle; package identification information for such unused or unnecessary software packages does not need to be included in the determination of package identification information for the game cycle. For example, in the scenario described above, package identification information for software package B would not be determined because software package B is not involved in producing the game cycle for the Egyptian-themed wagering game.

In block 135, the determined game history data, or a subset thereof, may be stored in non-volatile memory for potential later access. Such data storage may, for example, include storing the game history data for each game cycle in a separate file. Alternatively, the game history data for a game cycle may be stored as a record in a database, which may consist of one or more separate files. In some implementations, a hybrid approach may be used. For example, most game history data for a game cycle may be stored as a record in a database, but the game re-creation data for that game cycle may be stored as an individual file. The database record for that game cycle may provide a pointer to the memory location, e.g., a path name or other location identifier, where the associated game re-creation data file exists. In some implementations, the database record may not include any explicit pointer to a separate game re-creation data file, but information stored in the database record may be sufficient to uniquely identify the associated game re-creation file. For example, if the game re-creation files are stored in a specified standard location and are each named with a 12-digit code in the format YY6DD76SS, with YY indicating the two-digit year, 6 the two-digit month, DD the two-digit day, 7 the 24-hour clock hour, 6 the two-digit minutes, and SS the two-digit seconds correlating with a timestamp for that respective game cycle, this may be sufficient to locate the relevant game re-creation file based on timestamp data for the game cycle which may be stored in the database record. Such an implementation may require the filename to be augmented with additional identifiers if the implementation results in game re-creation files from multiple gaming machines being stored in the same standard location. This is because it may be possible that two gaming machines will each generate a game re-creation data file with the same timestamp; the additional identifiers may allow these two files to be differentiated from each other.

In block 140, the determined package identification information may be stored in non-volatile memory as well. Such package identification information may be stored in the same location as the game history data. For example, package identification information for a game cycle may be stored in a field of a database record used to store the game history data for that game cycle. Package identification information may also be stored in sub-records linked to the database record used to store the game history data for that game cycle. Package identification information may also be stored in a game history file. Alternative methods of associating the package identification information for a game cycle with the game history data for that game cycle may also be used. In some implementations, the determined package identification information may be stored in a different location than the game history data, although still in non-volatile memory.

In block 145, which is optional, various software packages which may have previously been used to provide a game cycle may be replaced or removed, e.g., unmounted, from the gaming machine. Such software packages may, for example, include software packages which are identified by package identification information for a past game cycle. Replacement of a software package may occur for various reasons. For example, a software package may be replaced by a slightly newer version of the same software package. In such scenarios, the same wagering game is still presented for play on the gaming machine, although one or more of the software packages used to provide game cycles for that wagering game may have different package identification information.

In another example, a software package may be replaced by a completely different software package if, for example, the gaming machine operator wishes to change the game or games offered by the gaming machine. Removal of a software package may occur for various reasons as well. For example, an operator may remove a software package because the software package is only used by a poor-performing game, and the operator wishes to remove that game from the gaming machine to discourage play of that game. In another example, a software package may be removed because the software package is only used by a game which has been banned or otherwise disallowed from play by a regulator agency. Software package removal or replacement may occur at various intervals, and may be driven by various factors. A multitude of game cycles may be provided before any software package removal or replacement occurs. It is to be understood that while software package removal or replacement is not required for use of this technique, certain aspects of the technique, as outlined further below, will only come into play when software packages are removed or replaced in between providing a game cycle and a later re-creation of the game cycle.

In block 150, a determination may be made as to whether game cycle re-creation is desired. For example, the gaming machine operator may interact with the gaming machine via a menu system to request game re-creation. In some implementations, the gaming machine operator may cause such interaction even mid-game cycle, although this may irritate the player whose game cycle is interrupted. In some implementations, the gaming machine may allow for mid-game cycle game re-creation and may "pause" the current game cycle until game cycle re-creation is completed. The current game cycle may then be resumed after game cycle re-creation is finished. If the gaming machine does not receive any instructions or indications that game cycle re-creation is requested, the gaming machine may proceed to provide a further game cycle to the player, e.g., return to block 110, or otherwise function in a normal game-providing manner.

If game cycle re-creation is requested, the technique proceeds to block 155. In block 155, a game cycle is selected for re-creation. Such selection may be provided, for example, by presenting a scrollable list of game cycles which may be re-created. An operator may access the list, scroll to the desired game cycle, and select the desired game cycle using, for example, a touch screen display. The scrollable list may only include game cycles for which there is game history data and package identification information.

In block 160, game history data and package identification information for the selected game cycle may be retrieved from memory, e.g., by retrieving one or more database records associated with the selected game cycle and/or by opening one or more files associated with the selected game cycle. In block 165, the selected game cycle may be re-created using the retrieved game history data and package identification information. Such re-creation is described more fully in the discussion below regarding FIG. 2. In block 170, technique 100 ends, although other activities may happen before the technique ends. For example, after the game cycle re-creation of block 165, the technique may ultimately return, for example, to block 110 for further play.

Game cycle re-creation may be implemented in several ways. For example, in one implementation, the game cycle is "re-created" using only text information, e.g., text values indicating the values of various game cycle variables stored within the game history data. As a practical matter, such an implementation may be limited to presenting data which is readily comprehensible by a human observer, such as meter values, amount bet, amount won, etc. In addition to the textual re-creation, some game-independent graphical content may also be displayed. For example, the gaming machine may also display a picture of the player using the gaming machine at the time the game cycle was provided—such a picture may, for example, be an image captured by a camera on the gaming machine at the time the game cycle was provided, or may be an identification photo associated with a player tracking account associated with the player using the gaming machine at the time the game cycle was provided. Another example of image data which may be displayed is biometric data, such as a fingerprint. These types of graphical data may be the same regardless of which software packages were used to provide the game cycle. These types of graphical data also may not require any processing by the software packages used to provide the game cycle in order to be rendered comprehensible by a human observer, e.g., such graphical data may be in an industry-standard format such as a JPEG or TI11 file format and may be displayed using any number of different programs or routines.

Other data, such as some data in the game re-creation data, may be presented in text form, but such data may be largely meaningless to a human observer because it is largely composed of software package-specific instructions or parameters which must be processed by the relevant software package or software packages in order to be transformed into graphical content which is meaningful to a human observer. Accordingly, many implementations may avoid presenting most game re-creation data in text form.

To present game re-creation data in meaningful form, game re-creation data may be provided to the software packages used to provide the relevant game cycle. The software packages may then, using the provided game re-creation data, re-create the graphics and sounds displayed and emitted, respectively, during the game cycle associated with the game re-creation data. The resulting game cycle graphical re-creation may be displayed on a display of the gaming machine in much the same manner as the game cycle was originally displayed, although perhaps scaled down or cropped to fit within a smaller area. In this manner, the game re-creation data may be transformed into a graphical and/or auditory form which is readily understandable by a human observer. However, it may not be possible to implement the second mode of game cycle re-creation described above, e.g., the graphical and/or auditory re-creation of the game cycle, if the software packages used to provide the original game cycle are no longer present or otherwise available on the gaming machine at the time the game cycle is re-created. Even if it is possible to graphically re-create a game cycle using software packages with different package identification information than the software packages used to originally provide the game cycle, it may still be preferable to utilize the software packages identified by the package identification information to ensure that the game cycle re-creation is of the highest fidelity.

Figure 2:
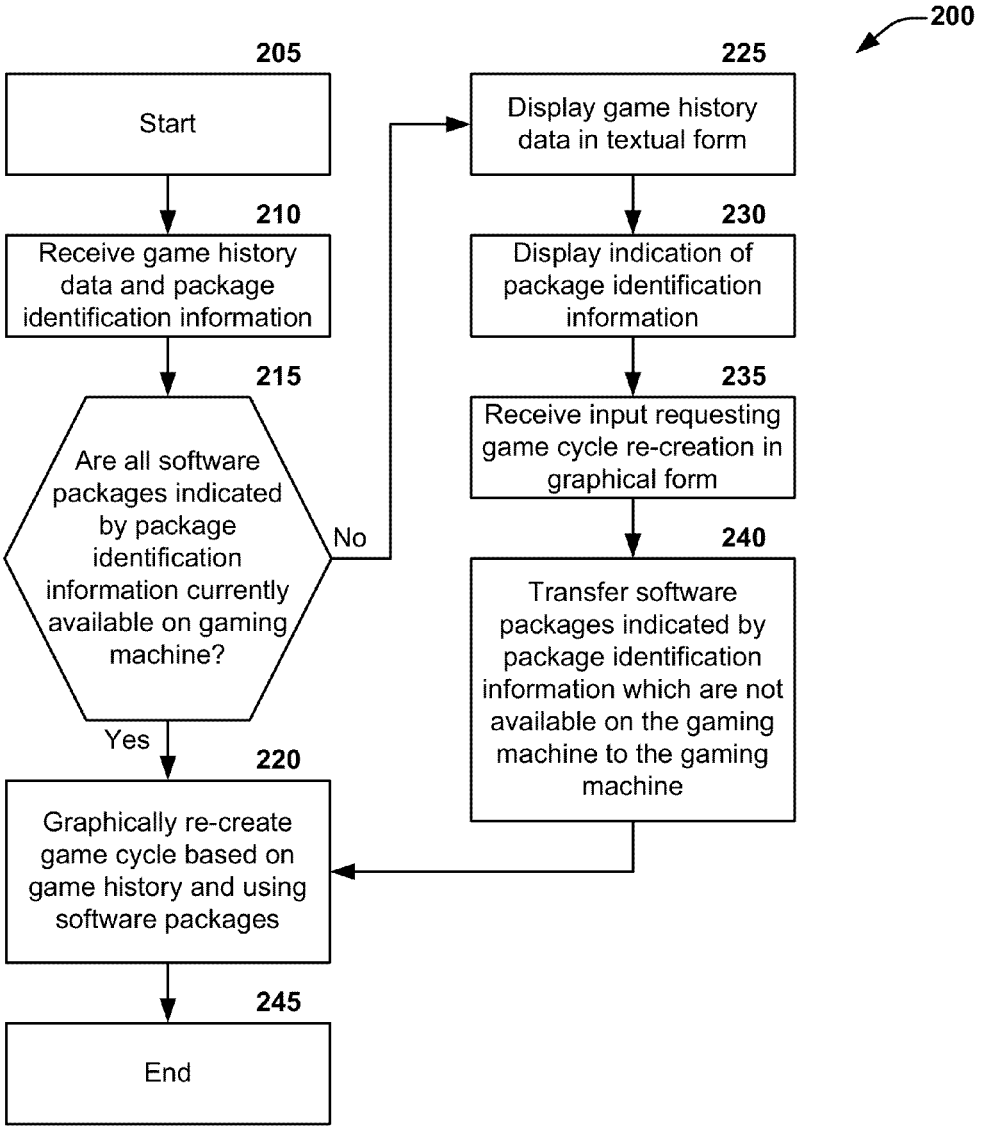
FIG. 2 shows a block diagram of one example of a technique for providing game cycle re-creation when software packages used to provide the game cycle may not be available on a gaming machine.

FIG. 2 depicts a flow diagram for one technique which may be used to re-create game cycles. Technique 200 starts in block 205. In block 210, game history data and package identification information for a selected game cycle are received by a gaming machine. The game history data and package identification information may, for example, be retrieved from a file or a database stored in the gaming machine's memory. In block 215, the software packages identified by the package identification information are compared to the software packages currently available for use on the gaming machine. If all of the software packages used to initially provide the selected game cycle are still available on the gaming machine, the game cycle may then be re-created graphically in block 220 by providing the game cycle re-creation data to the available software packages. However, if the gaming machine determines that one or more software packages identified by the package identification information for the selected game cycle are unavailable on the gaming machine, the gaming machine may, in block 225, forego graphical game cycle re-creation and instead re-create the game cycle using textual information and game-independent graphical content. The gaming machine may also, in block 230, supplement the display of game cycle textual information with additional information indicating which software packages indicated by the package identification information are currently unavailable on the gaming machine and will need to be provided in order to enable graphical game cycle re-creation.

In block 235, an input may be received by the gaming machine indicating that graphical re-creation is desired despite the present unavailability of some of the required software packages on the gaming machine. The gaming machine may then, in block 240, transfer the unavailable, but required, software packages to itself from another location such as, for example, a network asset such as a network-accessible storage unit or a server, or from a storage asset directly connected to the gaming machine, such as a flash memory device connected to a universal serial bus (USB) port of the gaming machine. The gaming machine, as part of the transfer process, may send a request for the needed software packages to a central server, which serves as an archive of all current and recently-current software packages. The server may then provide information to the gaming machine identifying a location from which the requested software package or packages may be obtained. In some implementations, the needed software packages may not be made available on the gaming machine, but be made virtually available to the gaming machine. For example, the gaming machine may be provided with a network address and file location where the requested software packages may be found. Rather than downloading the entire package to the gaming machine, the gaming machine may simply access the software package remotely. This may introduce some lag into the game cycle re-creation due to inefficiencies in the communications connection to the software package, but this may be acceptable in a game cycle re-creation setting as opposed to a real-time game play setting.

After all of the software packages required for graphical game cycle re-creation are made available on, or to, the gaming machine, the game cycle may be re-created graphically in addition to, or in place of, the textual re-creation, i.e., block 20. Technique 200 may end in block 245. Any transferred software packages used for game cycle re-creation may be deleted by the gaming machine after game cycle re-creation is completed. In some implementations, the transferred software packages may stay resident on the gaming machine even after game cycle re-creation and may, for example, only be deleted after an operator returns the gaming machine to normal play mode, or may be kept on the gaming machine until extra storage space is required on the gaming machine.

Figure 3:
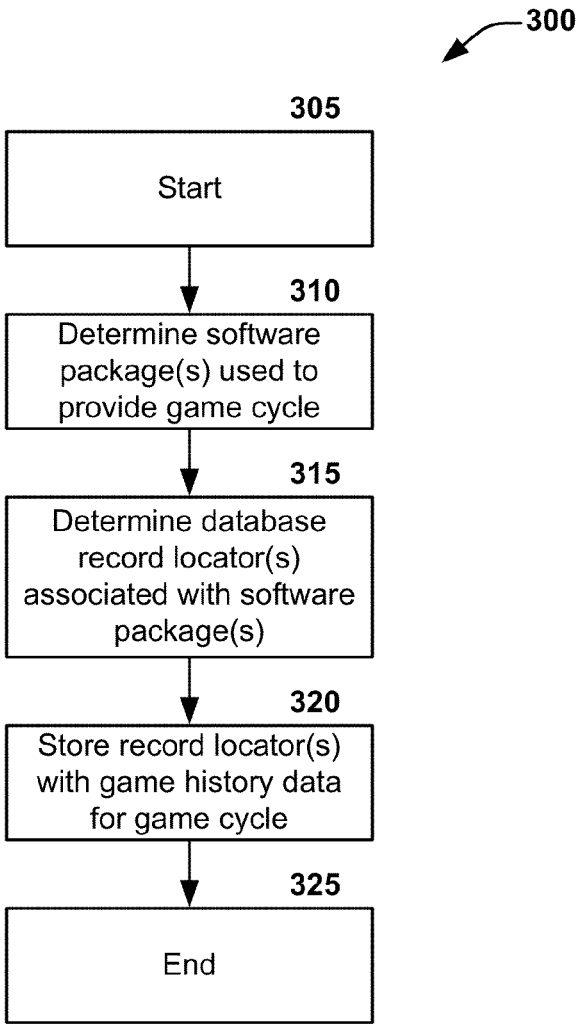
FIG. 3 shows a block diagram of one example of a technique for determining package identification information for software packages.

In some implementations, the package identification information may indirectly identify a software package or software packages. FIG. 3 illustrates one technique for indirectly identifying software packages. Software package identification technique 300 starts in block 305. In block 310, the various software packages which are needed to provide for a particular game cycle are identified. Such identification may be performed, for example, by one of the software packages via metadata or by an operating system or game management system which tracks which software packages are installed and in use on the gaming machine.

For example, in some gaming machine implementations, the various software packages which are mounted on a storage device of the gaming machine may be detected during an initialization process performed at boot-up and package identification information identifying those software packages may be compiled into one or more registries describing the gaming machine's software configuration. Such registries may be updated at a later time without rebooting the gaming machine. For example, if a software package is added, removed, or replaced, an update protocol may be initiated which re-performs the software package detection and updates a registry to reflect the change in software package status.

In some implementations, each software package may contain one or more metadata files which may use "descriptors" to identify the functionality provided by the software package, as well as descriptors of any additional functionality required for the software package to function correctly. For example, a particular software package may indicate, via descriptors in its contained metadata file or files, that the software package provides the underlying pay table data for the "Wolf Run" slot machine game, as well as graphics assets for the "Wolf Run" game. The descriptors in the contained metadata file or files may also indicate that, in order for a "Wolf Run" game using the underlying paytable to be provided, additional software packages providing additional functionality will be required, e.g., a software package providing bingo game functionality. The gaming machine may also inspect the metadata files for other software packages available on the gaming machine and, in some implementations, confirm that software packages providing the additional functionality are available. Software packages providing such additional functionality may be identified by the gaming machine and then associated with, for example, the software package including the Wolf Run paytable and graphics assets.

The gaming machine may, after scanning the metadata file or files for the software package, add an entry for "Wolf Run" to a registry or a portion of a registry used by the gaming machine to determine which games and paytables may be available on the gaming machine, as well as which software packages are required to provide game cycles for each game available on the gaming machine. The Wolf Run entry may also specify, or be linked to other registry entries which specify, the software package name, or some other unique identifier, for each software package associated with providing Wolf Run game play. Thus, during operation, the gaming machine may simply locate the registry entry for the Wolf Run game and be able to determine the identity of the software packages used to provide Wolf Run game play by reference to the registry. In this manner, package identification information may quickly be determined during gameplay for inclusion in the game history data of each game cycle.

In the event that a gaming machine offers more than one game for play, the gaming machine operating system may be configured to always be aware of which wagering game of the plurality of wagering games is currently presented for play. Thus, when game history data is generated for a particular game cycle, the gaming machine may utilize the package identification information for the wagering game which is presented for play at the time the game cycle occurs and store that package identification information with the game history data.

In block 315, the gaming machine may query a database of software package information to determine which database record or records correspond with the identified software package or software packages. A unique identifier for each such record may then be stored with the game history data in block 320. The technique may end in block 325. In some implementations, the package identification information for the identified software packages may simply be stored directly in the game history data.

Figure 4A:
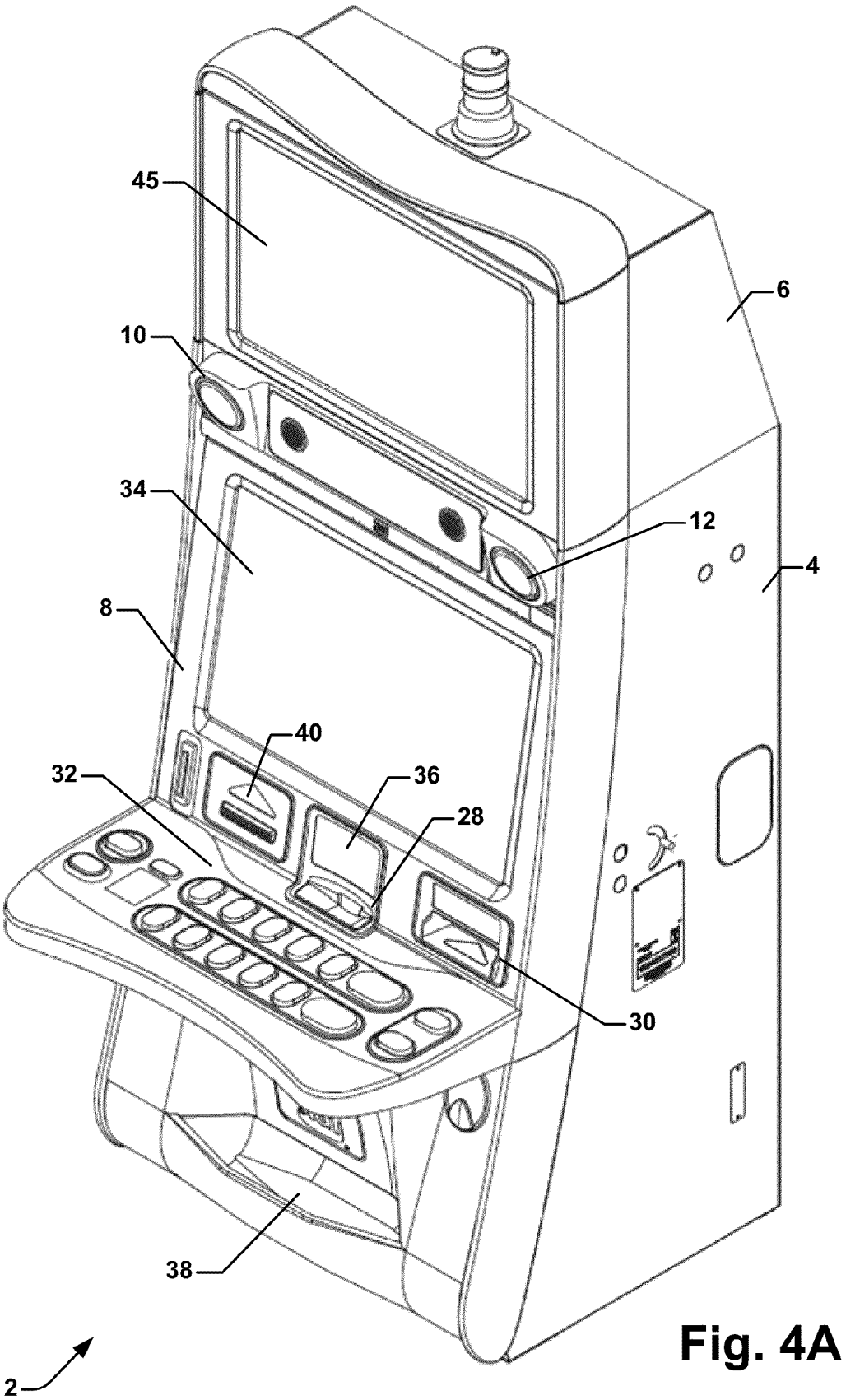
FIG. 4A shows an isometric view of an example of a gaming machine.
Figure 4B:
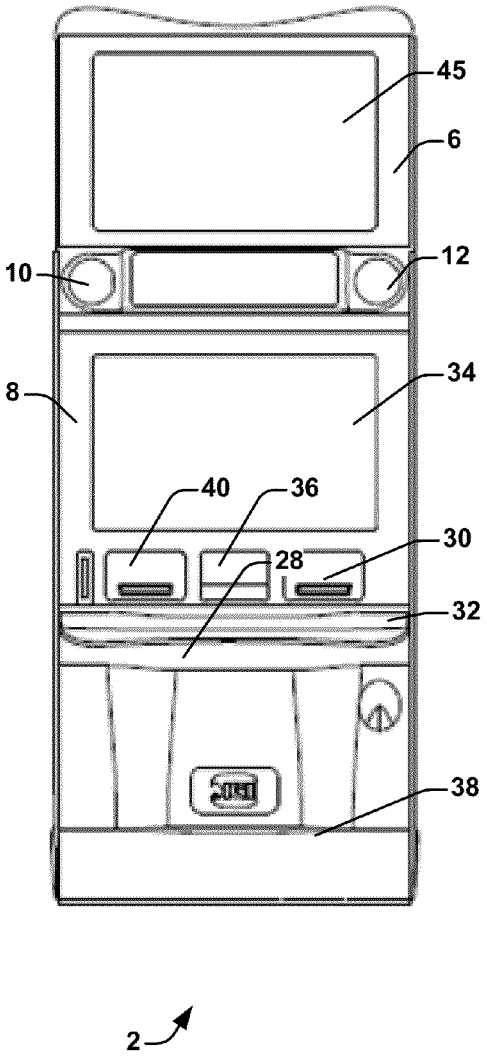
FIG. 4B shows a front view of the gaming machine of FIG. 4A.
Figure 4C:
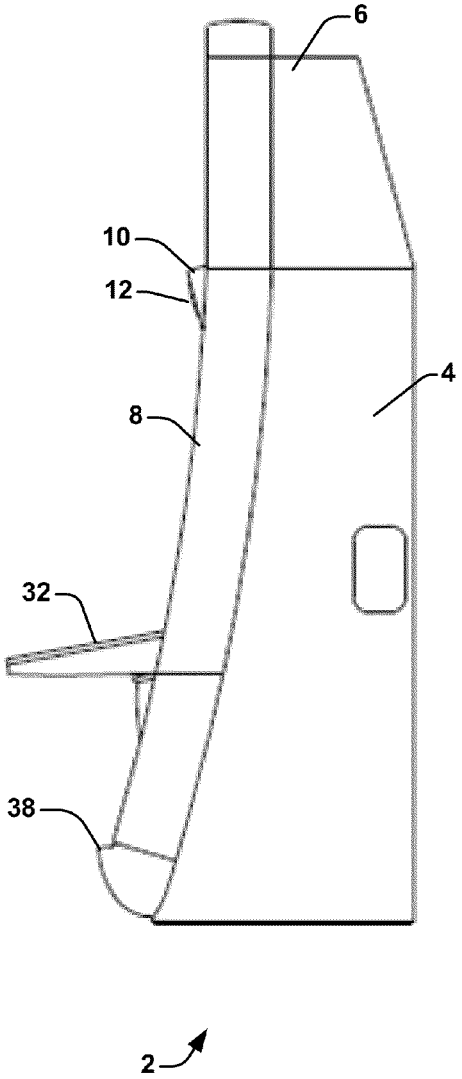
FIG. 4C shows a side view of the gaming machine of FIG. 4A.

Such techniques may be implemented, for example, using a gaming machine such as that shown in FIGS. 4A-4C. FIGS. 4A, 4B, and 4C show isometric, front, and side views, respectively, of a gaming machine 2, which may be used to support various implementations of the concepts discussed herein. As illustrated in FIGS. 4A-4C, gaming machine 2 includes a main cabinet 4, which generally surrounds the machine interior and is viewable by users. The main cabinet includes a main door 8 on the front of the machine, which opens to provide access to the interior of the machine.

In some implementations, the electronic gaming machine may include any of a plurality of devices. For example, the electronic gaming machine may include a ticket printer that prints bar-coded tickets, a key pad for entering player tracking information, a display (e.g., a video display screen) for displaying player tracking information, a card reader for entering a magnetic striped card containing player tracking information, and any other devices. The ticket printer may be used to print tickets for a cashless ticketing system. In FIGS. 4A-4C, attached to the main door is a payment acceptor 28, a bill validator 30, and a coin tray 38. The payment acceptor may include a coin slot and/or a payment, note, or bill acceptor, where the player inserts money, coins, tokens, or other types of payments.

In some implementations, devices such as readers or validators for credit cards, debit cards, smart cards, or credit slips may facilitate payment. For example, a player may insert an identification card into a card reader of the gaming machine. The identification card may be a smart card coded with a player's identification, credit totals (or related data) and other relevant information. As another example, a player may carry a portable device, such as a cell phone, a radio frequency identification tag or any other suitable wireless device. The portable device may communicates a player's identification, credit totals (or related data), and/or any other relevant information to the gaming machine. As yet another example, money may be transferred to a gaming machine through electronic funds transfer. When a player funds the gaming machine, another logic device coupled to the gaming machine may determine the amount of funds entered and display the corresponding amount on a display device.

In some implementations, attached to the main door are a plurality of player-input switches or buttons 32. The input switches can include any suitable devices which enables the player to produce an input signal which is received by the processor. The input switches may include a game activation device that may be used by the player to start any primary game or sequence of events in the gaming machine. The game activation device can be any suitable play activator such as a "bet one" button, a "max bet" button, or a "repeat the bet" button. In some instances, upon appropriate funding, the gaming machine may begin the game play automatically. Alternately, the gaming machine may automatically activate game play after detecting user input via the game activation device.

In some implementations, one input switch is a cash-out button. The player may push the cash-out button and cash out to receive a cash payment or other suitable form of payment corresponding to the number of remaining credits. For example, when the player cashes out, the player may receive the coins or tokens in a coin payout tray. As another example, the player may receive other payout mechanisms such as tickets or credit slips redeemable by a cashier (or other suitable redemption system) or funding to the player's electronically recordable identification card. As yet another example, funds may be transferred from the gaming machine to the player's smart card.

In some implementations, one input switch is a touch-screen coupled with a touch-screen controller, or some other touch-sensitive display overlay to enable for player interaction with the images on the display. The touch-screen and the touch-screen controller may be connected to a video controller. A player may make decisions and input signals into the gaming machine by touching the touch-screen at the appropriate places. One such input switch is a touch-screen button panel. Such a touch-screen may also be configured to provide operator interaction menus which may allow an operator to access non-play functionality of the gaming machine, such as diagnostics or game history re-creation.

In some implementations, the gaming machine may include communication ports for enabling communication of the gaming machine processor with external peripherals, such as external video sources, expansion buses, game or other displays, a SCSI port, a key pad, or a network interface for communicating via a network. Such a network interface may be used to connect gaming machine 2 to a gaming network and to network-accessible storage devices from which software packages unavailable on gaming machine 2 may be downloaded.

In some implementations, the gaming machine may include a label area, such as the label area 36. The label area may be used to display any information or insignia related to activities conducted at the gaming machine.

In some implementations, the electronic gaming machine may include one or more display devices. For example, the electronic gaming machine 2 includes display devices 34 and 45. The display devices 34 and 45 may each include any of a cathode ray tube, an LCD, a light emitting diode (LED) based display, an organic light emitting diode (OLED) based display, a polymer light emitting diode (PLED) based display, an SED based-display, an E-ink display, a plasma display, a television display, a display including a projected and/or reflected image, or any other suitable electronic display device. The display devices may be used during game cycle re-creation to display textual and/or graphical game cycle re-creations.

In some implementations, the display devices at the gaming machine may include one or more electromechanical devices such as one or more rotatable wheels, reels, or dice. The display device may include an electromechanical device adjacent to a video display, such as a video display positioned in front of a mechanical reel. The display devices may include dual-layered or multi-layered electromechanical and/or video displays that cooperate to generate one or more images. The display devices may include a mobile display device, such as a smart phone or tablet computer, that allows play of at least a portion of the primary or secondary game at a location remote from the gaming machine. The display devices may be of any suitable size and configuration, such as a square, a rectangle or an elongated rectangle.

In some implementations, the display devices of the gaming machine are configured to display game images or other suitable images. The images may include symbols, game indicia, people, characters, places, things, faces of cards, dice, and any other images. The images may include a visual representation or exhibition of the movement of objects such as mechanical, virtual, or video reels and wheel. The images may include a visual representation or exhibition of dynamic lighting, video images, or any other images.

In some implementations, the electronic gaming machine may include a top box. For example, the gaming machine 2 includes a top box 6, which sits on top of the main cabinet 4. The top box 6 may house any of a number of devices, which may be used to add features to a game being played on the gaming machine 2. These devices may include speakers 10 and 12, display device 45, and any other devices. Further, the top box 6 may house different or additional devices not illustrated in FIGS. 1-2B. For example, the top box may include a bonus wheel or a back-lit silk screened panel which may be used to add bonus features to the game being played on the gaming machine. As another example, the top box may include a display for a progressive jackpot offered on the gaming machine. As yet another example, the top box may include a smart card interaction device. During a game, these devices are controlled and powered, at least in part, by circuitry (e.g. a master gaming controller) housed within the main cabinet 4 of the gaming machine 2.

In some implementations, speakers may be mounted and situated in the cabinet with an angled orientation toward the player. For instance, the speakers 10 and 12 located in top box area 6 of the upper region of gaming machine 2 may be mounted and situated in the cabinet with an angled orientation down towards the player and the floor. In one example, the angle is 45 degrees with respect to the vertical, longitudinal axis of machine 2. In another example, the angle is in a range of 30-60 degrees. In another example, the angle is any angle between 0 and 90 degrees. In some implementations, the angle of speakers in the gaming machine may be adjustable. For instance, speakers may be adjusted to face in a direction more closely approximating an estimated position of a player's head or facial features.

The bill validator 30, player-input switches 32, display screen 34, and other gaming devices may be used to present a game on the game machine 2. The devices may be controlled by code executed by a master gaming controller housed inside the main cabinet 4 of the machine 2. The master gaming controller may include one or more processors including general purpose and specialized processors, such as graphics cards, and one or more memory devices including volatile and non-volatile memory. The master gaming controller may periodically configure and/or authenticate the code executed on the gaming machine.

In some implementations, the gaming machine may include a sound generating device coupled to one or more sounds cards. The sound generating device may include one or more speakers or other sound generating hardware and/or software for generating sounds, such as playing music for the primary and/or secondary game or for other modes of the gaming machine, such as an attract mode. The gaming machine may provide dynamic sounds coupled with attractive multimedia images displayed on one or more of the display devices to provide an audio-visual representation or to otherwise display full-motion video with sound to attract players to the gaming machine. During idle periods, the gaming machine may display a sequence of audio and/or visual attraction messages to attract potential players to the gaming machine. The videos may also be customized for or to provide any appropriate information.

In some implementations, the gaming machine may include a sensor, such as a camera that is selectively positioned to acquire an image of a player actively using the gaming machine and/or the surrounding area of the gaming machine. The sensor may be configured to capture biometric data about a player in proximity to the gaming machine. The biometric data may be used to implement mechanical and/or digital adjustments to the gaming machine. Alternately, or additionally, the sensor may be configured to selectively acquire still or moving (e.g., video) images. The display devices may be configured to display the image acquired by the camera as well as display the visible manifestation of the game in split screen or picture-in-picture fashion. For example, the camera may acquire an image of the player and the processor may incorporate that image into the primary and/or secondary game as a game image, symbol, animated avatar, or game indicia. In some implementations, the sensor may be used to trigger an attract mode effect. For example, when the sensor detects the presence of a nearby player, the gaming machine may play sound effects or display images, text, graphics, lighting effects, or animations to attract the player to play a game at the gaming machine.

Gaming machine 2 is but one example from a wide range of gaming machine designs on which the techniques described herein may be implemented. For example, not all suitable gaming machines have top boxes or player tracking features. Further, some gaming machines have only a single game display—mechanical or video—while others may have multiple displays.

Figure 6:
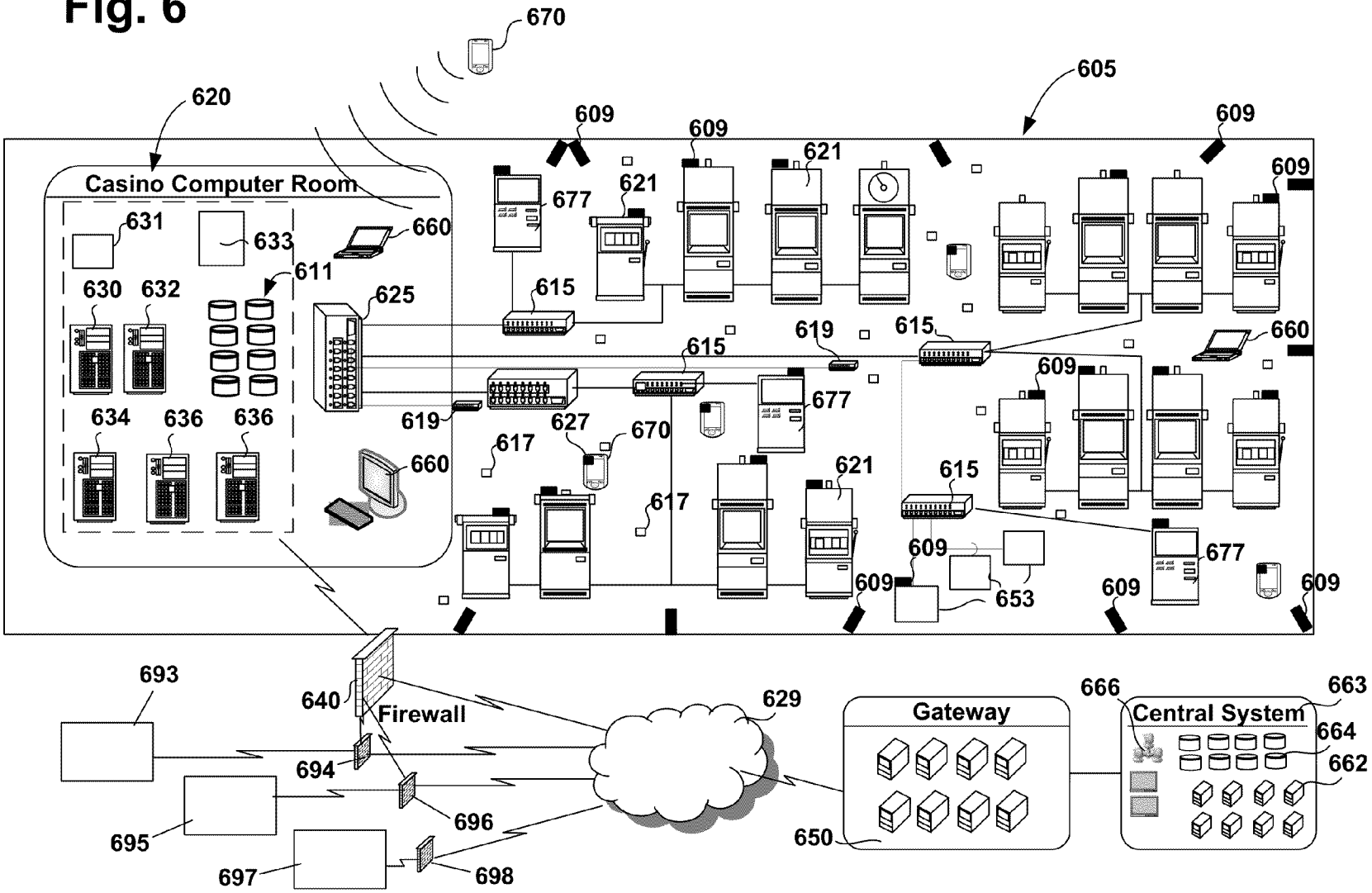
FIG. 6 shows a system diagram for an example of a casino gaming network.

Game history data and package identification information may be stored, for example, on the non-volatile memory of the master gaming controller. In some implementations, the game history data and package identification information may be stored on non-volatile memory elsewhere in the gaming machine, for example, on a removable storage medium, such as a flash memory drive. In some other implementations, some or all of the game history data and package identification information may be additionally, or alternatively, stored on non-volatile memory located outside of the gaming machine, such as on a hard drive of a server or network-accessible storage device accessible via a gaming network to which the gaming machine is connected. An example of such a network is shown in FIG. 6.

Figure 5:
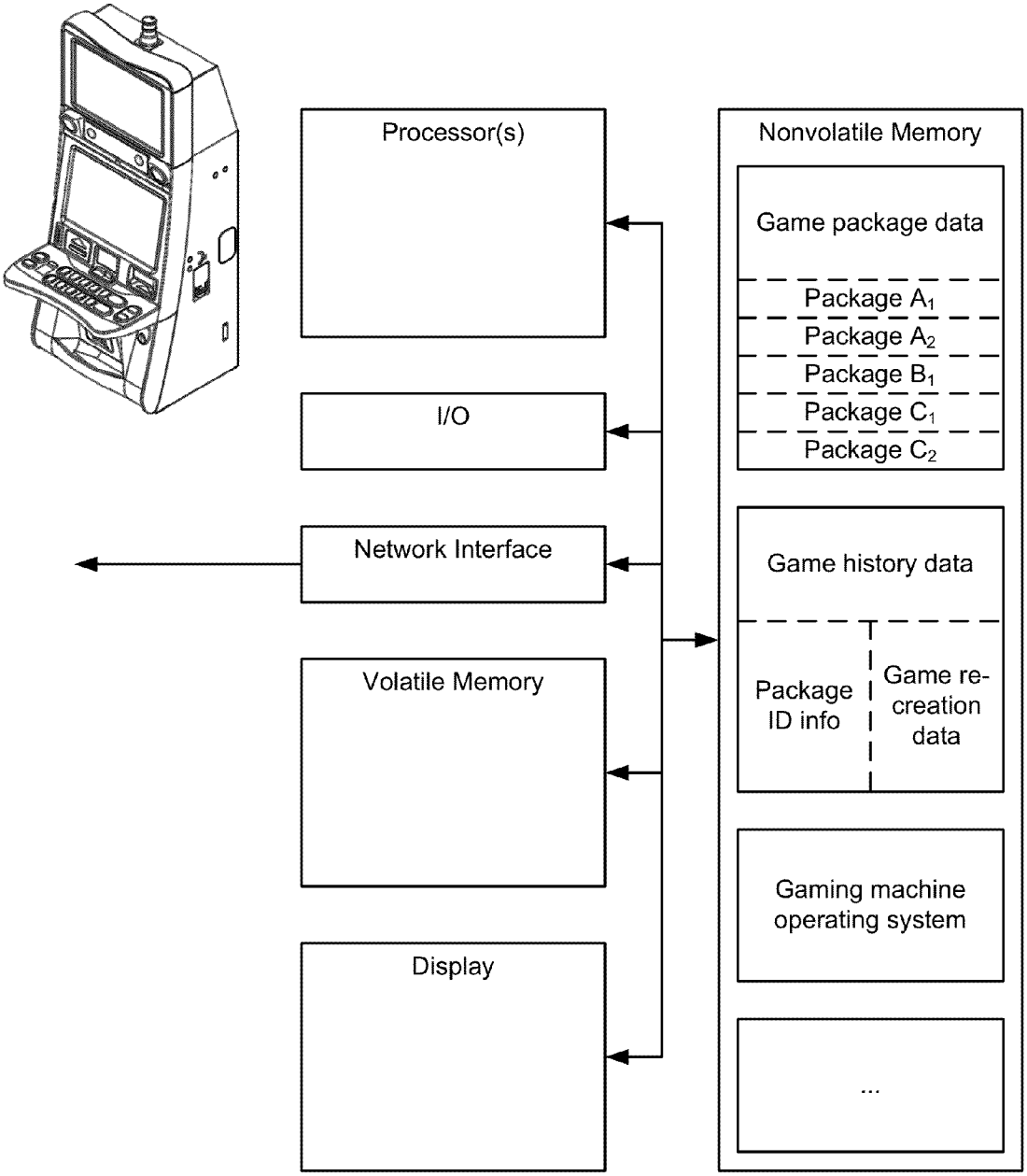
FIG. 5 shows a block system diagram for an example of a gaming machine.

FIG. 5 shows a system block diagram for a gaming machine which may be used to implement the techniques outlined herein. Gaming system 500 for gaming machine 505 may include one or more processors 510 which are communicatively connected with I/O interface 515, network interface 520, volatile memory 525, display 530, and nonvolatile memory 535.

One or more processors 510 may execute software which provides game cycle re-creation functionality, and may also provide wagering game functionality, software package identification, and other functionality described herein as part of a game history re-creation technique. One or more processors 510 may be configured to communicate with resources external to gaming machine 505 using network interface 520 or I/O interface 515 to, for example, retrieve software packages unavailable on gaming machine 505. Volatile memory 525 may, for example, be used to store game software routines while game cycles of wagering games are provided and to store data for a game registry during boot-up of the gaming machine.

Nonvolatile memory 535, which may also be generally referred to as a storage system of gaming machine 505, may be used to store, for example, game software package data 540. For example, software packages $A_1$, $A_2$, $B_1$, $C_1$, and $C_2$, and so forth may be mounted on nonvolatile memory 535. Nonvolatile memory 535 may also store game history data 550, which may include package identification information 552 and game re-creation data 553. Nonvolatile memory 535 may also store gaming machine operating system 555, which may inspect game software package data 540 and compile a registry of installed software packages 540, as well as monitor which wagering game is being played at the time that any game history data 550 is stored. Nonvolatile memory 560 may also store other data which may be used by gaming machine 505, such as drivers for devices, player tracking data, etc.

FIG. 6 shows a server-based (Sb™) gaming network which may be used to implement some of the techniques or systems as described above. Those of skill in the art will realize that this architecture and the related functionality are merely examples and that the present disclosure encompasses many other such implementations and methods.

Here, casino computer room 620 and networked devices of a gaming establishment 605 are illustrated. Gaming establishment 605 is configured for communication with central system 663 via gateway 650. Gaming establishments 693 and 695 are also configured for communication with central system 663.

In some implementations, gaming establishments may be configured for communication with one another. In this example, gaming establishments 693 and 695 are configured for communication with casino computer room 620. Such a configuration may allow devices and/or operators in casino 605 to communicate with and/or control devices in other casinos. In some such implementations, a server in computer room 620 may control devices in casino 605 and devices in other gaming establishments. Conversely, devices and/or operators in another gaming establishment may communicate with and/or control devices in casino 605.

Here, gaming establishment 697 is configured for communication with central system 663, but is not configured for communication with other gaming establishments. Some gaming establishments (not shown) may not be in communication with other gaming establishments or with a central system. Gaming establishment 605 includes multiple gaming machines 621, each of which is part of a bank 610 of gaming machines 621. In this example, gaming establishment 605 also includes a bank of networked gaming tables 653. However, the present disclosure may be implemented in gaming establishments having any number of gaming machines, gaming tables, etc. It will be appreciated that many gaming establishments include hundreds or even thousands of gaming machines 621 and/or gaming tables 653, not all of which are necessarily included in a bank and some of which may not be connected to a network. At least some of gaming machines 621 and/or mobile devices 670 may be "thin clients" that are configured to perform client-side methods as described elsewhere herein. Gaming machines 621 may, for example, be configured to provide the first and second levels of access and issue and receive temporary IDs, much as gaming machines 405 and 410 are configured.

Some configurations can provide automated, multi-player roulette, blackjack, baccarat, and other table games. The table games may be conducted by a dealer and/or by using some form of automation, which may include an automated roulette wheel, an electronic representation of a dealer, etc. In some such implementations, devices such as cameras, radio frequency identification devices, etc., may be used to identify and/or track playing cards, chips, etc. Some of gaming tables 653 may be configured for communication with individual player terminals (not shown), which may be configured to accept bets, present an electronic representation of a dealer, indicate game outcomes, etc.

Gaming establishment 605 also includes networked kiosks 677. Depending on the implementation, kiosks 677 may be used for various purposes, including but not limited to cashing out, prize redemption, redeeming points from a player loyalty program, redeeming "cashless" indicia such as bonus tickets, smart cards, generating temporary IDs, creating new player tracking accounts based on temporary IDs, etc. In some implementations, kiosks 677 may be used for obtaining information about the gaming establishment, e.g., regarding scheduled events (such as tournaments, entertainment, etc.), regarding a patron's location, etc. Software related to such features may be provided and/or controlled, and related data may be obtained and/or provided, according to the present disclosure. For example, in some implementations of the disclosure, kiosks 677 may be configured to receive information from a patron, e.g., such as temporary IDs or account creation data.

In this example, each bank 610 has a corresponding switch 615, which may be a conventional bank switch in some implementations. Each switch 615 is configured for communication with one or more devices in computer room 620 via main network device 625, which combines switching and routing functionality in this example. Although various communication protocols may be used, some preferred implementations use the Gaming Standards Association's G2S Message Protocol. Other implementations may use IGT's open, Ethernet-based SuperSAS® protocol, which IGT makes available for downloading without charge. Still other protocols, including but not limited to Best of Breed ("BOB"), may be used to implement various implementations of the disclosure. IGT has also developed a gaming-industry-specific transport layer called CASH that rides on top of TCP/IP and offers additional functionality and security.

Here, gaming establishment 605 also includes an RFID network, implemented in part by RFID switches 619 and multiple RFID readers 617. An RFID network may be used, for example, to track objects (such as mobile gaming devices 670, which include RFID tags 627 in this example), patrons, etc., in the vicinity of gaming establishment 605.

As noted elsewhere herein, some implementations of the disclosure may involve "smart" player loyalty instruments, such as player tracking cards, which include an RFID tag. Accordingly, the location of such RFID-enabled player loyalty instruments may be tracked via the RFID network. In this example, at least some of mobile devices 670 may include an RFID tag 627, which includes encoded identification information for the mobile device 670. Accordingly, the locations of such tagged mobile devices 670 may be tracked via the RFID network in gaming establishment 605. Other location-detection devices and systems, such as the global positioning system ("GPS"), may be used to monitor the location of people and/or devices in the vicinity of gaming establishment 605 or elsewhere.

Various alternative network topologies can be used to implement different implementations of the disclosure and/or to accommodate varying numbers of networked devices. For example, gaming establishments with large numbers of gaming machines 621 may require multiple instances of some network devices (e.g., of main network device 625, which combines switching and routing functionality in this example) and/or the inclusion of other network devices not shown in FIG. 6. Some implementations of the disclosure may include one or more middleware servers disposed between kiosks 677, RFID switches 619 and/or bank switches 615 and one or more devices in computer room 620 (e.g., a corresponding server). Such middleware servers can provide various useful functions, including but not limited to the filtering and/or aggregation of data received from switches, from individual gaming machines and from other devices. Some implementations of the disclosure include load-balancing methods and devices for managing network traffic.

Storage devices 611, Sb™ server 630, License Manager 631, Arbiter 633, servers 632, 634, 636 and 638, host device(s) 660 and main network device 625 are disposed within computer room 620 of gaming establishment 605. In practice, more or fewer devices may be used. Depending on the implementation, some such devices may reside in gaming establishment 605 or elsewhere.

One or more devices in central system 663 may also be configured to perform, at least in part, tasks specific to the present disclosure. For example, one or more servers 662, storage devices 664 and/or host devices 660 of central system 663 may be configured to implement the functions described in detail elsewhere herein.

One or more of the servers of computer room 620 may be configured with software for receiving a player's wager gaming notification parameters, determining when a wagering condition corresponds with the wager gaming notification parameters and/or providing a notification to the player when the wagering condition corresponds with the wager gaming notification parameters.

Other devices that may be deployed in network 605 do not appear in FIG. 6. For example, some gaming networks may include not only various radio frequency identification ("RFID") readers 617, but also RFID switches, middleware servers, etc., some of which are not depicted in FIG. 6. These features may provide various functions. For example, a server (or another device) may determine a location of a mobile device 670 according to the location of an RFID reader that reads an RFID tag 627.

The servers and other devices indicated in FIG. 6 may be configured for communication with other devices in or outside of gaming establishment 605, such as host devices 660, kiosks 677 and/or mobile devices 670, for implementing some methods described elsewhere herein. Servers (or the like) may facilitate communications with such devices, receive and store patron data, provide appropriate responses, etc., as described elsewhere herein.

Some of these servers may be configured to perform tasks relating to accounting, player loyalty, bonusing/progressives, configuration of gaming machines, etc. One or more such devices may be used to implement a casino management system, such as the IGT Advantage™ Casino System suite of applications, which provides instantaneous information that may be used for decision-making by casino managers. A Radius server and/or a DHCP server may also be configured for communication with the gaming network. Some implementations of the disclosure provide one or more of these servers in the form of blade servers.

Some implementations of Sb™ server 630 and the other servers shown in FIG. 6 include (or are at least in communication with) clustered CPUs, redundant storage devices, including backup storage devices, switches, etc. Such storage devices may include a "RAID" (originally redundant array of inexpensive disks, now also known as redundant array of independent disks) array, back-up hard drives and/or tape drives, etc.

In some implementations of the disclosure, many of these devices (including but not limited to License Manager 631, servers 632, 634, 636, and 638, and main network device 625) are mounted in a single rack with Sb™ server 630. Accordingly, many or all such devices will sometimes be referenced in the aggregate as an "Sb™ server." However, in alternative implementations, one or more of these devices is in communication with Sb™ server 630 and/or other devices of the network but located elsewhere. For example, some of the devices could be mounted in separate racks within computer room 620 or located elsewhere on the network. Moreover, it can be advantageous to store large volumes of data elsewhere via a storage area network ("SAN").

Computer room 620 may include one or more operator consoles or other host devices that are configured for communication with other devices within and outside of computer room 620. Such host devices may be provided with software, hardware and/or firmware for implementing various implementations of the disclosure. However, such host devices need not be located within computer room 620. Wired host devices 660 (which are desktop and laptop computers in this example) and wireless devices 670 (which are PDAs in this example) may be located elsewhere in gaming establishment 605 or at a remote location.

Figure 7:
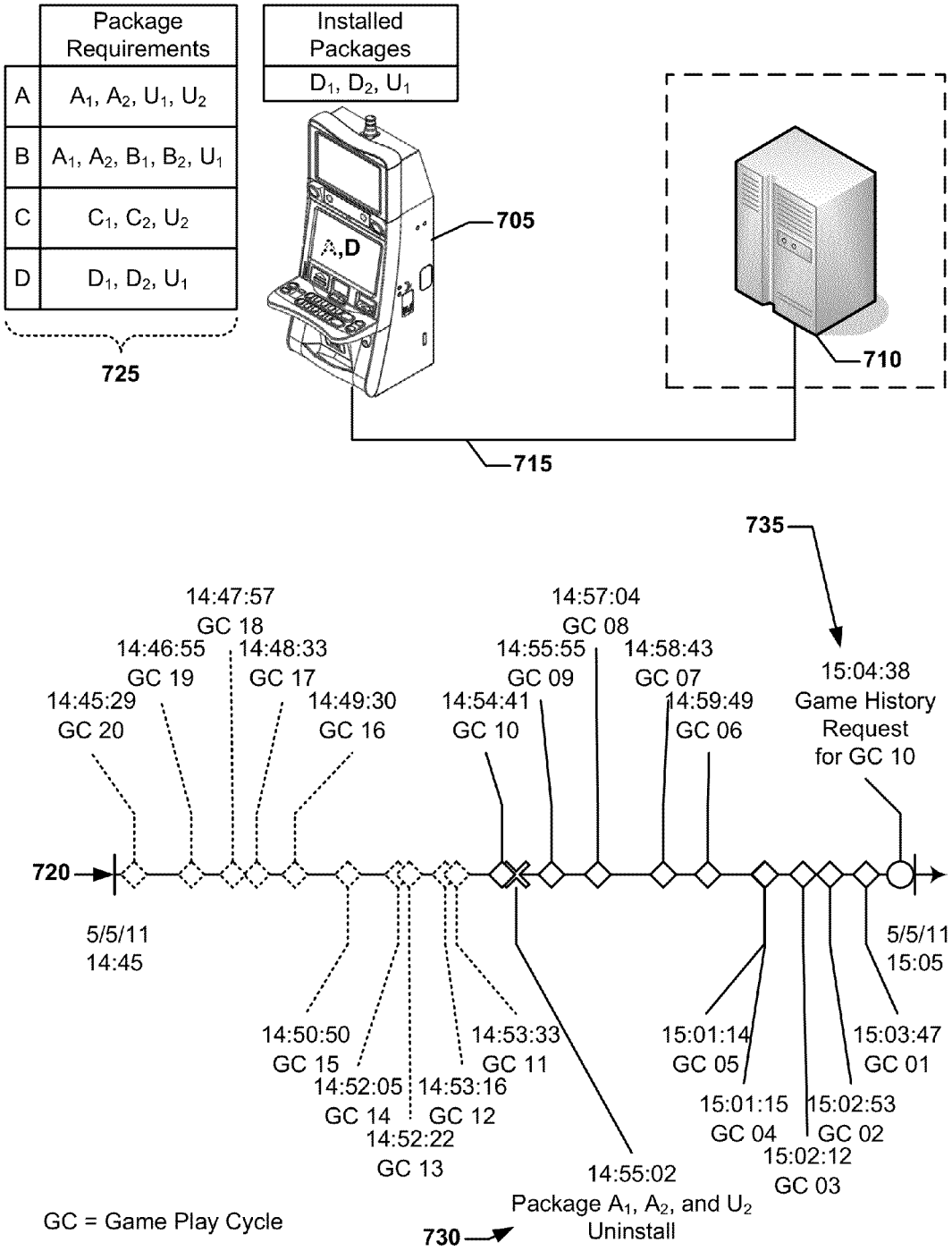
FIG. 7 shows a system diagram and timeline of an example of a game cycle re-creation system.

FIG. 7 depicts a diagram of an implementation in which a gaming machine may retrieve software packages via a gaming network, such as that shown, for example, in FIG. 6, from a remote storage source. Gaming machine 705 may initially be configured to provide wagering games A and D. Table 725 shows software packages required to provide game cycles for wagering games A, B, C, and D. For example, wagering game A requires software packages $A_1$, $A_2$, $U_1$, and $U_2$ and wagering game D requires software packages $D_1$, $D_2$, and $U_1$.

Timeline 720 shows a representative time period (from 2:45 PM to 3:05 PM on May 5, 2011) during which gaming machine 705 provides 20 game cycles (GC) of either wagering game A or wagering game D. In between GC10 and GC09, software packages $A_1$, $A_2$, and $U_2$ are uninstalled from the gaming machine. Thus, while GC20-GC10 may be game cycles for either wagering game A or wagering game D, GC09-GC01 may only be game cycles for wagering game D since the software packages for providing wagering game A are not available during GC09-GC01. In this example, it is assumed that GC15-GC10 are game cycles for wagering game A. The letter "A" is shown greyed-out on gaming machine 705 to indicate that, at the time of game cycle re-creation, wagering game A is no longer available on gaming machine 705.

After the most recent game cycle, i.e., GC01, a request is made to graphically re-create the game cycle for GC10. Gaming machine 705 may retrieve the game history data and package identification information for GC10. The package identification information may, for example, indicate that file TypeA103322 was used for software package $A_1$, that file TypeA204977 was used for software package $A_2$, and that software package GConU2922185 was used for software package $U_2$ to provide GC10. However, files TypeA103322, TypeA204977, and GConU2922185 were removed from gaming machine 705 when wagering game A was uninstalled. Thus, when re-creation of GC10 is requested at 15:04:38, gaming machine 705 may display a screen similar to that shown in FIG. 8.

Figure 8:
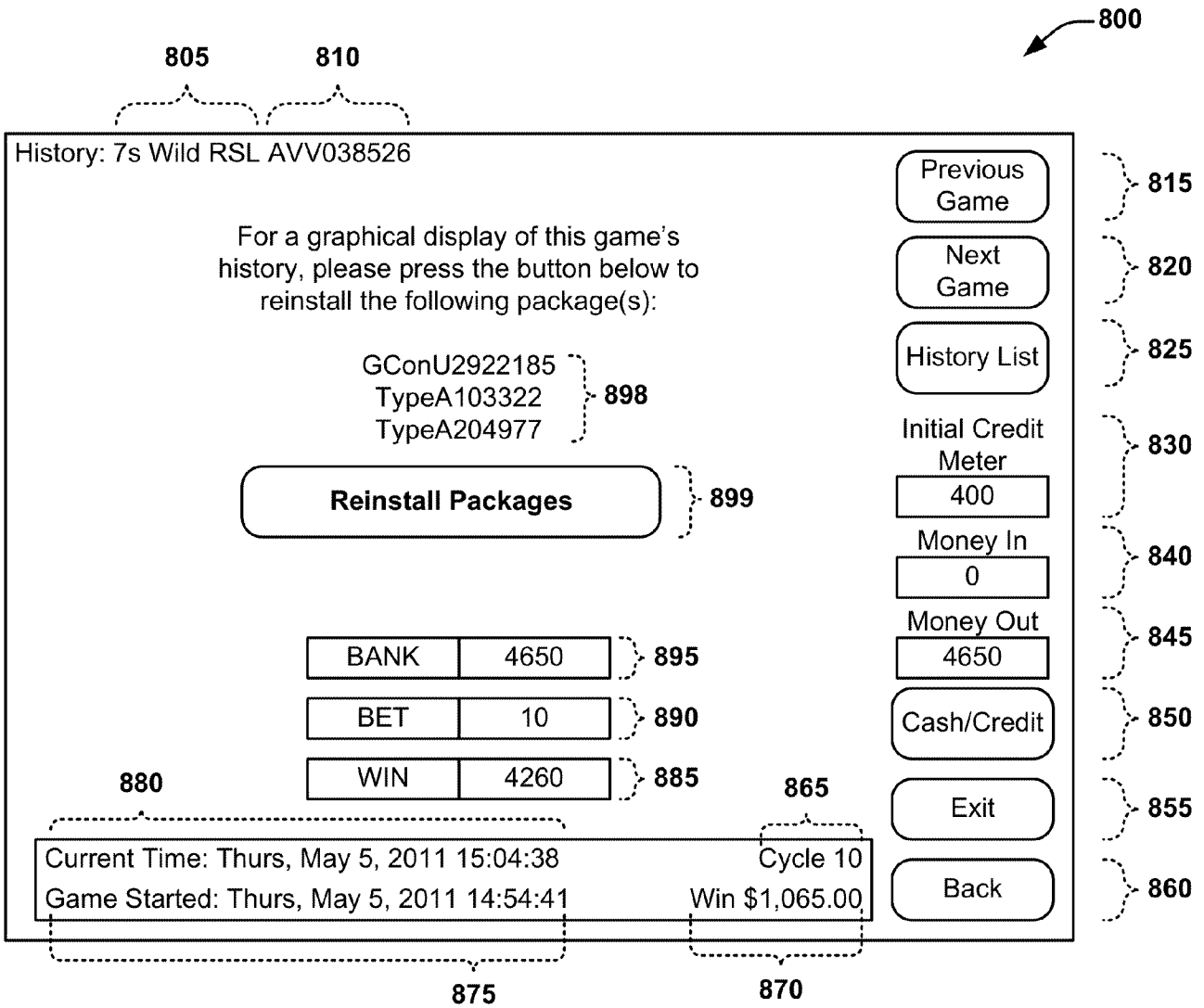
FIG. 8 shows an example of a screen interface showing textual game cycle re-creation.

In FIG. 8, a game cycle re-creation display 800 is shown for game cycle GC10 of FIG. 7. Game cycle re-creation display 800 is a textual game cycle re-creation since the software packages required for game cycle re-creation of GC10 are no longer available on gaming machine 705. Theme identifier 805 may identify the theme of the wagering game which provided GC10. Paytable identifier 810 may identify the pay table underlying the wagering game which provided GC10.

Button 815 may be used to navigate to the game cycle occurring just prior to the current re-created game cycle. Button 820 may be used to navigate to the game cycle just after the current re-created game cycle. Button 825 may be used to bring up a list, e.g., a scrollable list, of game cycles available for re-creation. A particular game cycle may be selected from such a list and then re-created on game cycle re-creation display 800.

Initial credit meter 830 may display the initial meter value for the gaming machine at the start of a gaming session in which GC10 occurred. Money in 840 may display the amount of additional credits added to the meter by the player during the session, and money out 845 may display the amount of credits withdrawn from the gaming machine at the end of the session. A session may include one or more game cycles; each session generally represents a series of uninterrupted game cycles provided to a player.

Cash/credit button 850 may allow the operator to switch the values shown in 830, 840, and 845 between "credits" and "cash" values. For a gaming machine in which 1 credit=$1, cash/credit button 850 may have no discernible effect (except, in some implementations, adding or removing "$" before the value). However, for a gaming machine in which $1=4 credits, this may cause the display of cash and credits to change by a factor of four or one quarter.

Exit button 855 may allow the operator to completely exit game cycle re-creation mode and return the gaming machine to its normal state of operation, e.g., providing wagering games. Back button 860 may allow the operator to exit game cycle re-creation mode without returning to normal game play mode. Instead, back button 860 may return the operator to a base menu from which diagnostic, configuration, or game history commands may be selected.

In the information bar along the bottom of game cycle re-creation display 800, the current time 880 may be displayed, e.g., 3:04:38 PM, along with the time 875 associated with, in this case, GC10, e.g., 2:54:41 PM. Game cycle identifier 865 may indicate how many game cycles back in time the currently-displayed game cycle is. In this example, GC10 is the tenth game cycle back. Win indicator 870 may be used to display the amount of winnings for GC10 in dollar amount.

Second win indicator 885 may indicate the amount of winnings for GC10 in credit amount. Bet indicator 890 may indicate the amount of credits bet on the outcome of GC10. Bank indicator 895 may indicate the amount of winnings accumulated by a player; in some jurisdictions, e.g., the United Kingdom, banked winnings may not be wagered until transferred by a player from the bank meter to the credit meter. The various indicators shown may differ depending on the requirements of the jurisdiction in which a game is offered. For example, in United States jurisdictions, bank indicator 895 may not be included since a bank meter may not be used.

Package identification information 1298 may indicate, in textual form, the game software packages needed to graphically re-create GC10 which are currently unavailable on the gaming machine. As can be seen, software packages TypeA103322, TypeA204977, and GConU2922185 are listed. Some implementations, such as the depicted one, may not indicate any file extensions for software packages as these may not be useful for uniquely identifying the software packages. Other implementations may include such file extensions. Still other implementations may utilize a completely different identifier which still allows for unique identification of the relevant software packages.

Reinstall button 899 may allow the operator to request that the gaming machine attempt to reinstall the unavailable software packages listed in package identification information 898. Selecting reinstall button 899 may cause the gaming machine to attempt to retrieve the unavailable software packages from another source, such as a network storage asset. For example, in FIG. 7, gaming machine 705 may seek to obtain copies of software packages TypeA103322, TypeA204977, and GConU2922185 from server 710 via gaming network 715. In some implementations, reinstall button 899 may not be provided, and an operator may need to manually provide or install the listed software packages.

Figure 9:
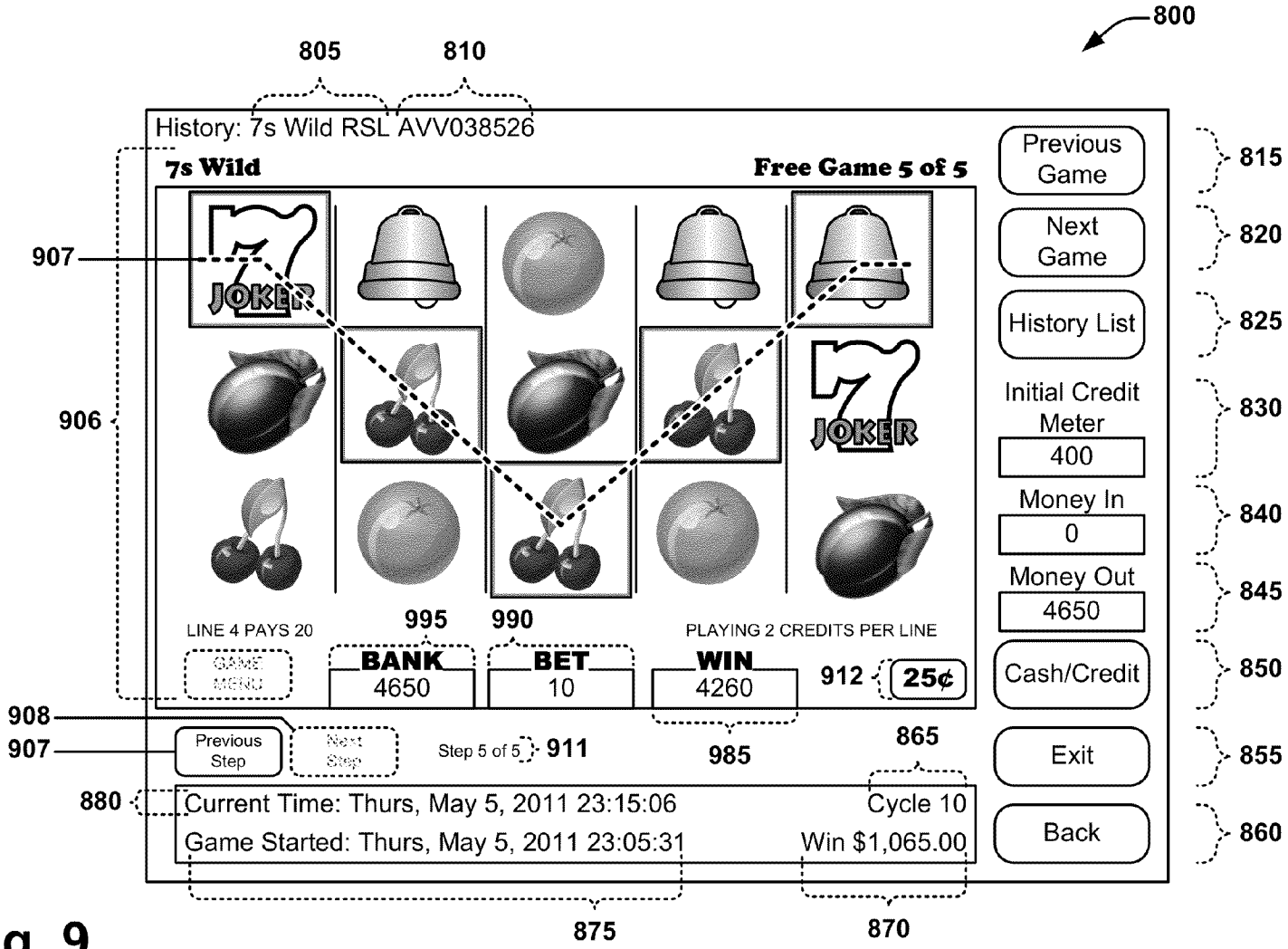
FIG. 9 shows an example of a screen interface showing graphical game cycle re-creation.

After software packages TypeA103322, TypeA204977, and GConU2922185 have been reinstalled and made available for game cycle re-creation on gaming machine 705, graphically-enhanced game cycle re-creation display 900 may be displayed on a display of gaming machine 705. Graphically enhanced game cycle re-creation display 900 may share many elements in common with game cycle re-creation display 800, such as previous/next game buttons 815/820, history list button 825, etc. In addition to these common elements, however, graphically-enhanced game cycle display 900 may include a graphical re-creation window 906 which depicts some or all of the content displayed when GC10 was initially provided. The graphical content shown in graphical re-creation window 906 may, for example, include graphics assets from the retrieved software packages. The graphical content depicted in graphical re-creation window 906 may also be manipulated according to data contained within game re-creation data files associated with the game cycle being re-created. For example, in the slot game shown, payline 907 has been overlaid across the displayed reels. By way of another example, in some implementations, the symbols shown for each reel of the five-reel "7s Wild RSL" game of FIG. 9 may be animated in a manner similar to how such symbols were animated when the original game cycle was provided.

Graphical re-creation window 906 may also include further data, such as denomination 912 of the game. Some textual information presented in game cycle re-creation display 800 may also be re-created in essentially the same form, although in a different format. For example, bank indicator 895, bet indicator 890, and win indicator 885 may be included in graphical re-creation window in a different location, and perhaps with different fonts, than shown in game cycle re-creation display 800.

Additional controls may also be provided. For example, previous step button 908 and next step 909 may be provided to allow an operator to step through the various game history events which occurred during GC10. In this example, GC10 has five steps, and graphical re-creation window 906 depicts the fifth step. Previous step button 908 would allow the operator to revert to the fourth step, and so forth. Next step button 909 is "greyed" out in FIG. 9 since there are no further steps to advance through for GC10. Step indicator 911 may be used to indicate which step is being displayed, and how many total steps are present.

Figure 10:
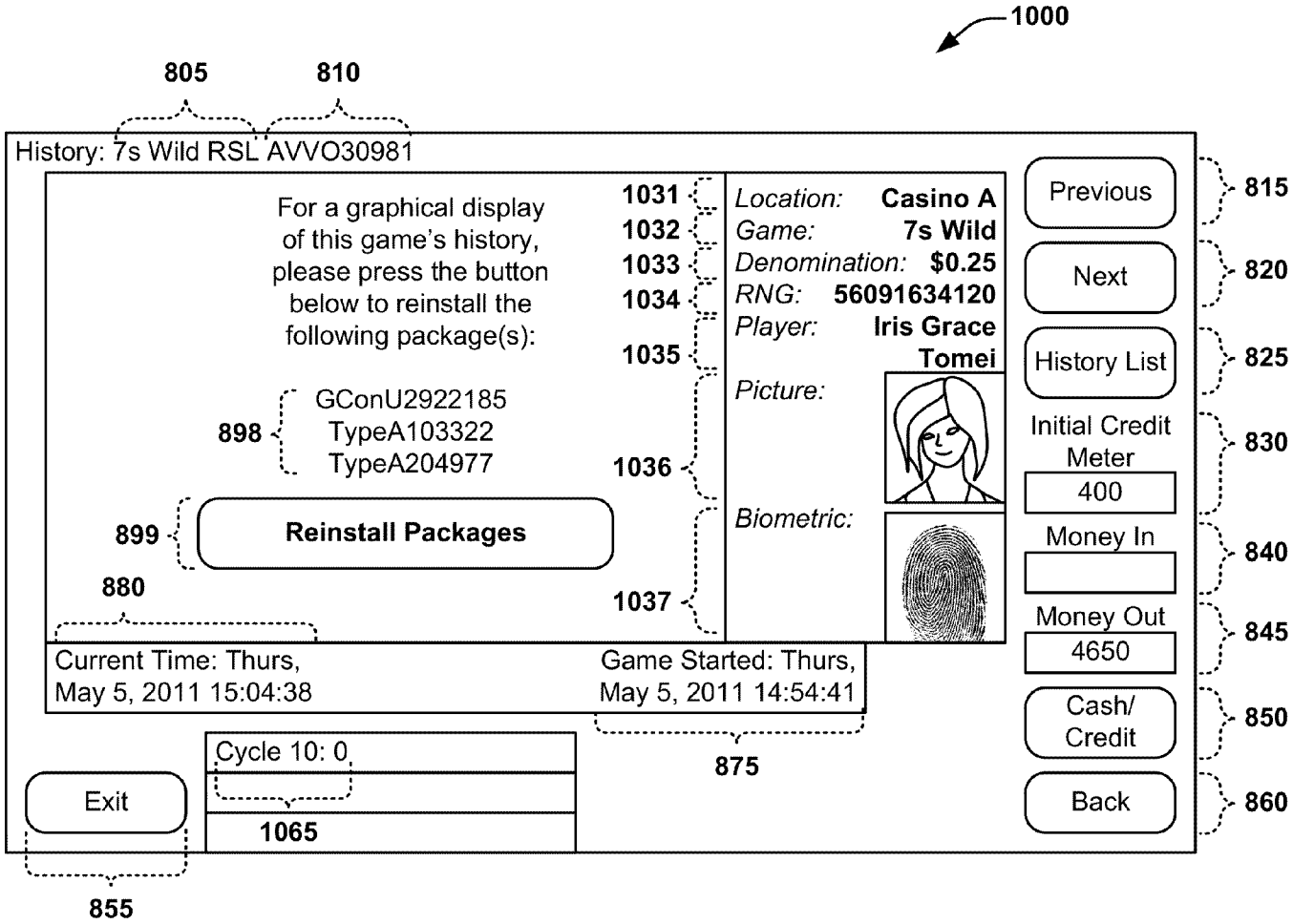
FIG. 10 shows an example of a screen interface showing another textual game cycle re-creation.

FIG. 10 depicts another implementation of a game cycle re-creation display. Game cycle re-creation display 1000 includes structures also shown in game cycle re-creation display 800 of FIG. 8; these same structures are indicated by similar callout numbers.

Game cycle re-creation display 1000 also features a cluster of additional textual and graphical data which is displayed even when graphical game cycle re-creation is not possible. For example, game location indicator 1031 indicates the location of the gaming machine when the selected game cycle, e.g., GC10, was provided. Such information may seem to be redundant on gaming machines since a gaming machine will generally be in the same location during game cycle re-creation as it was when the game cycle was originally provided. However, such information may be useful when re-creating a game cycle on a machine other than the gaming machine which originally provided it. For example, a game re-creation terminal, as described in more detail later in this paper, may be used to re-create game cycles provided by a variety of different gaming machines which are in locations other than the game re-creation terminal.

Game indicator 1032 may serve a similar purpose as theme indicator 805, although it may provide a more meaningful description of the game which provided the game cycle being re-created. Game denomination 1033 may indicate the base denomination of the game which provided the game cycle being re-created.

RNG indicator 1034 may indicate a random number or numbers generated by a random number generator and used to determine the outcome of the game cycle being re-created. RNG indicator 1034 may additionally, or alternatively, indicate a seed number used to produce a random number with the random number generator. In practice, the number shown may actually be much greater in length, or may be expressed in another format, such as a hexadecimal number.

Player name indicator 1035 may, if known, indicate the identity of the player playing the gaming machine when the game cycle was provided. Such identity information may be determined by referencing player tracking credentials in use on the gaming machine at the time the game cycle was provided. Player image 1036 may further identify the player using the gaming machine when the game cycle was provided. Player image 1036 may be obtained, for example, from a player tracking account. Alternatively, player image 1036 may be captured simultaneously with the providing of the game cycle by a camera associated with the gaming machine. The camera may be configured to capture an image of the player seating (or standing) area in front of the gaming machine and, in this manner, an image of the player using the gaming machine.

Biometric indicator 1037 may further identify the player using the gaming machine at the time the game cycle is initially provided. Such biometric data may be obtained, for example, as part of a player tracking account authorization procedure. In some gaming machines, various controls may have fingerprint scanners integrated with various controls used during game play, allowing the gaming machine to capture fingerprint images during each game cycle, and these game cycle-specific fingerprint images may be stored as part of the game history data for a given game cycle. Further examples of such integrated fingerprint scanners may be found in U.S. patent application Ser. No. 10/899,908, filed Jul. 27, 2004, by Chauncey Griswold et al, which is hereby incorporated by reference in its entirety.

Game cycle indicator 1065 may provide data similar to game cycle indicator 865 and step indicator 911, but in a combined format. In FIG. 10, game cycle indicator 1065 indicates that game cycle GC10 is being re-created and that step 0 of GC10 is being displayed. Step 0 may, for example, be a placeholder indicating that no step is currently being displayed since there is no graphical game cycle re-creation shown.

Figure 11:
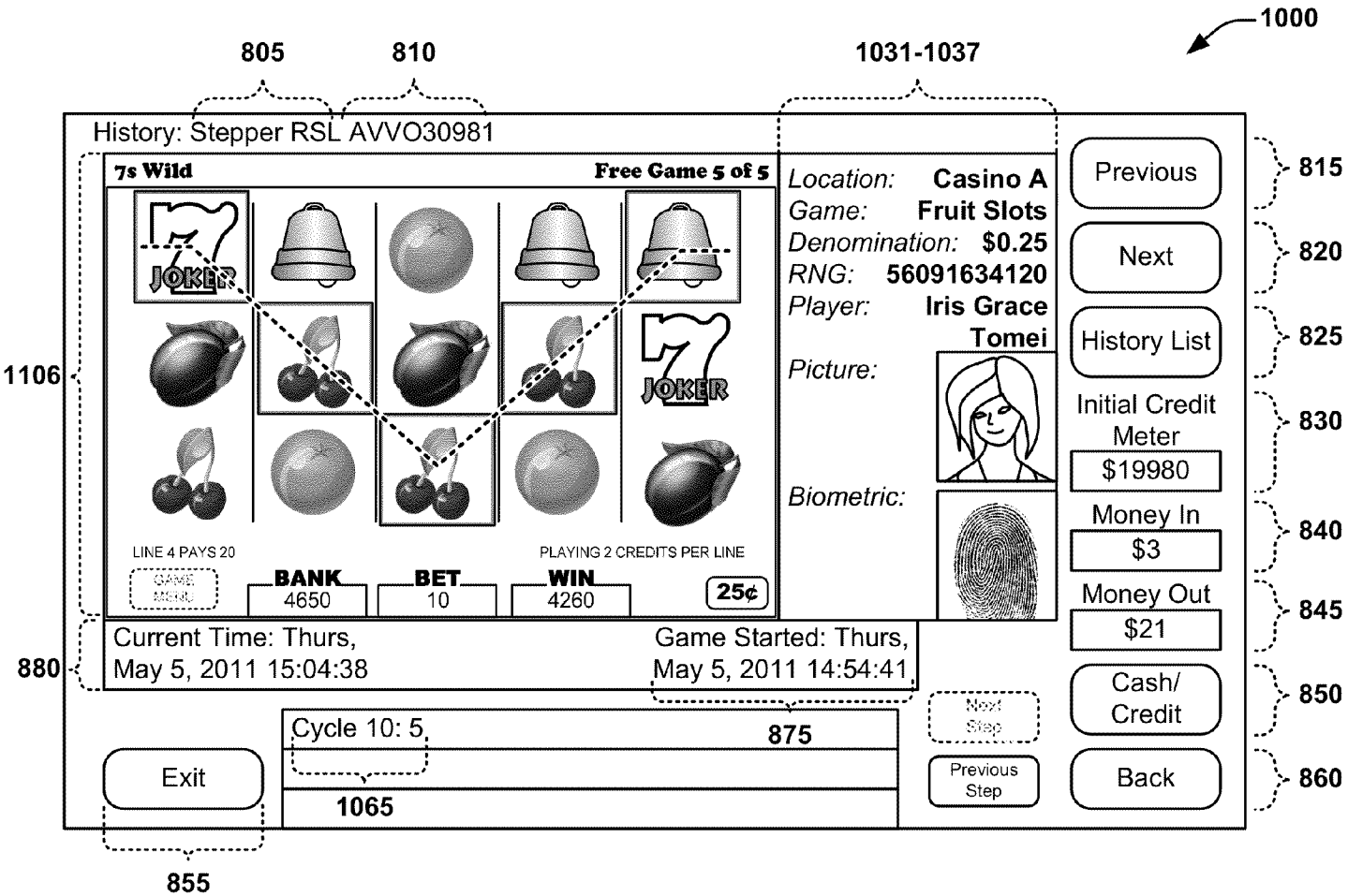
FIG. 11 shows an example of a screen interface showing another graphical game cycle re-creation.

FIG. 11 depicts game re-creation display 1000, but after unavailable game software packages have been made available to the gaming machine and used to provide a graphical re-creation of game cycle GC10. As can be seen, the resulting display is very similar to that shown in FIG. 9, although with the addition of indicators 1031-1037.

In some implementations, game cycle re-creation may take place elsewhere than on the gaming machine which initially provided the game cycle. For example, a special-purpose game re-creation terminal may be located in a casino office and used to re-create game cycles occurring on any of a multitude of different gaming machines. In such an implementation, the terminal may, for example, access game history data, game re-creation data, and software packages stored on a particular gaming machine over a gaming network in order to provide for re-creation of a game cycle originally provided by that particular gaming machine. The game re-creation terminal may determine which software packages beyond those available from the gaming machine will be needed in order to re-create the desired game cycle; the terminal may display a textual re-creation if there are missing software packages, or may obtain the missing software packages from another source, such as from a network repository of software packages.

In some game re-creation terminal implementations, the terminal may be equipped with, or connected to via a network, one or more storage devices which may store software packages used on a variety of different gaming machines at a variety of different times. Such storage devices may include successive versions of the same software package, and may be accessed by the terminal in order to provide the particular software packages identified by a selected game cycle's package identification information. In such implementations, the terminal may frequently (or always) have all of the potential software packages needed to re-create any given game cycle provided by any of the gaming machines in the variety of gaming machines. In such implementations, the package identification information for a selected game cycle allows the terminal to only select the correct software packages from the larger set of all available software packages. In this manner, the package identification information may act more as a filter used to screen out unneeded but available software packages than a "still-needed" list of unavailable software packages.

Figure 12:
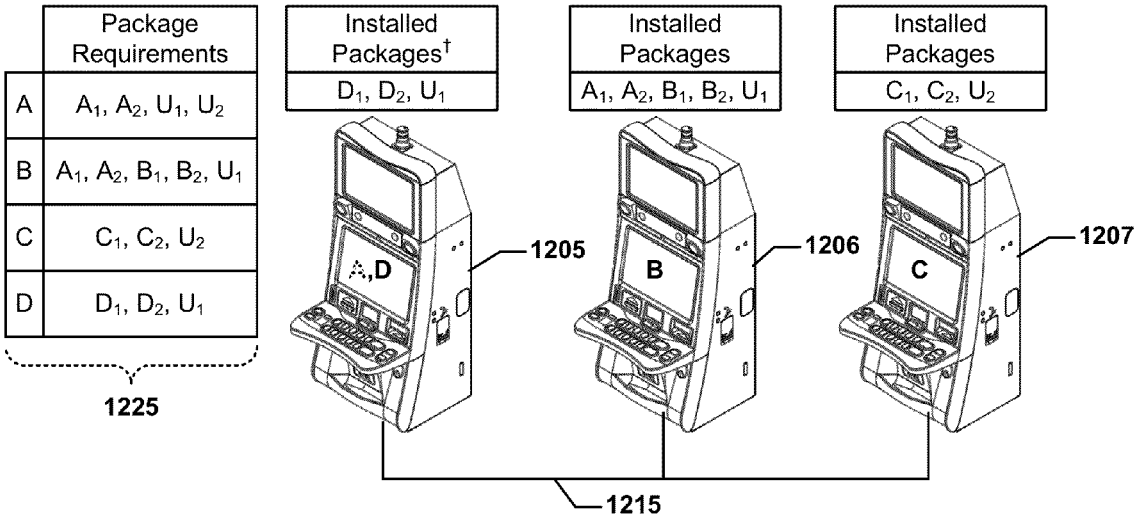
FIG. 12 shows a system diagram and timeline of an example of a game cycle re-creation system using peer-to-peer software package provisioning.
Figure 12:
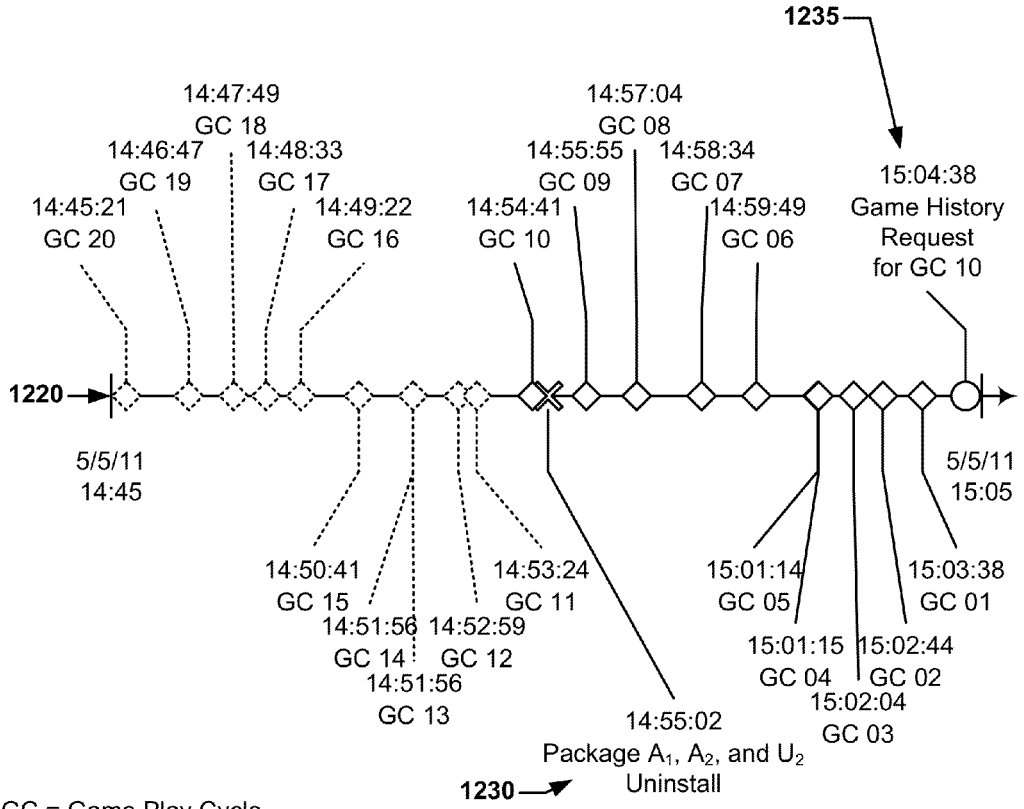

In some implementations, such as the implementation shown in FIG. 12, a gaming machine may retrieve software packages unavailable on the gaming machine via peer-to-peer transfers rather than by downloading from a central server. In FIG. 12, gaming machines 1205, 1206, and 1207 are communicatively connected via gaming network 1215. Twenty game cycles for gaming machine 1205 occurring during a time period between 2:45 PM and 3:05 PM on May 5, 2011, are depicted on timeline 1220.

Gaming machine 1205 is initially configured to offer both wagering game A and wagering game D. Gaming machines 12206 and 12207 are configured to offer wagering games B and C, respectively. Wagering game A requires software packages $A_1$, $A_2$, $U_1$, $U_2$, wagering game B requires software packages $A_1$, $A_2$, $B_1$, $B_2$, $U_1$, wagering game C requires software packages $C_1$, $C_2$, $U_2$, and wagering game D requires software packages $D_1$, $D_2$, $U_1$. At 2:55:02, software packages $A_1$, $A_2$, $U_2$ are uninstalled from gaming machine 1205. This causes wagering game A to cease to be available on gaming machine 1205 since three of the four software packages required to provide wagering game A have been uninstalled. The faded-out "A" on gaming machine 1205 indicates that gaming machine 1205 currently offers wagering game D and used to offer wagering game A.

At 3:04:30 PM, a request is made on gaming machine 1205 to re-create game cycle GC10, which occurred at 2:54:41 PM, i.e., just prior to the uninstallation of software packages $A_1$, $A_2$, $U_2$ from gaming machine 1205. Gaming machine 12 may retrieve the game history data and package identification information for GC10. The package identification information may, for example, indicate that file TypeA103322 was used for software package $A_1$, that file TypeA204977 was used for software package $A_2$, and that software package GConU2922185 was used for software package $U_2$ to provide GC10. However, files TypeA103322, TypeA204977, and GConU2922185, corresponding with software were removed from gaming machine 1205 when wagering game A was uninstalled. Thus, when re-creation of GC10 is requested at 15:04:38, gaming machine 1205 may display a screen similar to that shown in FIG. 8, i.e., a game cycle re-creation display without graphical game cycle re-creation.

Gaming machine 1205 may, rather than requesting the unavailable software packages from a central server, query other gaming machines on the gaming network to see if the unavailable software packages may be obtained from peer gaming machines on the gaming network. In the depicted scenario, unavailable software packages $A_1$ and $A_2$ may be found on gaming machine 1206, and unavailable software package $U_2$ may be found on gaming machine 1207. Gaming machine 1205 may thus request that gaming machines 1206 and 1207 allow gaming machine 1205 to download the required software packages from gaming machine 1206 and 1207. This implementation may allow for rapid transfer of required software packages to gaming machine 1205 without creating a bottleneck at a single server network interface. In some implementations, gaming machine 1205 may obtain a single software package from multiple other gaming machines by making partial downloads of the software package from each other gaming machine and then reassembling the software package from the partial downloads once received by gaming machine 1205.

These and other aspects of the disclosure may be implemented by various types of hardware, software, firmware, etc. For example, some features of the disclosure may be implemented, at least in part, by machine-readable media that include program instructions, state information, etc., for performing various operations described herein. Examples of program instructions include both machine code, such as produced by a compiler, and files containing higher-level code that may be executed by the computer using an interpreter. Examples of machine-readable media include, but are not limited to, magnetic media such as hard disks, floppy disks, and magnetic tape; optical media such as CD-ROM disks; magneto-optical media; and hardware devices that are specially configured to store and perform program instructions, such as read-only memory devices ("ROM") and random access memory ("RAM").

Any of the above implementations may be used alone or together with one another in any combination. Although various implementations may have been motivated by various deficiencies with the prior art, which may be discussed or alluded to in one or more places in the specification, the implementations do not necessarily address any of these deficiencies. In other words, different implementations may address different deficiencies that may be discussed in the specification. Some implementations may only partially address some deficiencies or just one deficiency that may be discussed in the specification, and some implementations may not address any of these deficiencies.

While various implementations have been described herein, it should be understood that they have been presented by way of example only, and not limitation. Thus, the breadth and scope of the present application should not be limited by any of the implementations described herein, but should be defined only in accordance with the following and later-submitted claims and their equivalents.

It will be understood that this disclosure contemplates and envisions that specific features of the disclosed implementations can be selectively combined. It will therefore be further appreciated that the above description has been given by way of example only and that modifications in detail may be made within the scope of the claims and their equivalents.

What is claimed is:

1. A method for processing game cycles on a wager gaming machine for later game cycle re-creation, the wager gaming machine including a processor, an acceptor, a validator, and a memory, the method comprising:

when a physical item associated with a monetary value is received via the acceptor, identifying, by the validator, the received physical item and establishing, by the processor, a credit balance for a player based at least in part on the monetary value associated with the received and identified physical item;

providing, by the processor, and using one or more software packages available on the wager gaming machine, one or more game cycles;

storing in the memory, for each provided game cycle, package identification information indicating the one or more software packages used by the wager gaming machine to provide the game cycle;

storing in the memory, for each provided game cycle, game history data associated with the package identification information for the game cycle, the game history data including data produced by the one or more software packages and defining an outcome of the game cycle, the game history data further including player information relating to the player of the wager gaming machine during the one or more game cycles;

receiving, by the wager gaming machine, a request that a past game cycle be re-created on the wager gaming machine;

determining, by the processor and responsive to receiving the request, whether any of the one or more software packages indicated by the package identification information associated with the past game cycle are presently unavailable on the wager gaming machine;

when any of the one or more software packages indicated by the package identification information associated with the past game cycle are presently unavailable on the wager gaming machine, displaying, on a display of the gaming machine, textual information previously displayed during the past game cycle and requesting each presently unavailable software package be sent to the wager gaming machine from a source other than the wager gaming machine and receiving said presently unavailable software packages;

creating, by the processor, a representation of the past game cycle using the game history data and the one or more software packages indicated by the package identification information associated with the past game cycle; and displaying, on the display of the gaming machine, the representation of the past game cycle and a visual representation of the player information relating to the player of the wager gaming machine during the past game cycle.

2. The method of claim 1, wherein each game cycle represents a single game play of a wagering game.

3. The method of claim 2, wherein at least one of the one or more game cycles is for a poker game and each of the at least one game cycle for the poker game includes dealing an initial card hand, one or more rounds of bets, and a determination of one or more winning card hands.

4. The method of claim 2, wherein each game cycle includes an initial wager and a game outcome determination associated with the initial wager, and which includes, at a close of the game cycle, enabling the player of the game cycle to cash out.

5. The method of claim 2, wherein at least one of the one or more game cycles is for a slot machine game and each of the at least one game cycle for the slot machine game includes an initial wager, a reel-spin, and a determination of at least one pay line outcome.

6. A method for processing game cycles on a wager gaming machine, the wager gaming machine including a processor, an acceptor, a validator, and a memory, the method comprising:

when a physical item associated with a monetary value is received via the acceptor, identifying, by the validator, the received physical item and establishing, by the processor, a credit balance for a player based at least in part on the monetary value associated with the received and identified physical item;

providing, by the processor, one or more games of chance for play;

providing, by the processor, and using one or more software packages available on the wager gaming machine, one or more game cycles of the one or more games of chance provided by the wager gaming machine;

determining, by the processor, for each game cycle provided by the wager gaming machine, game history data for the game cycle and package identification information indicating one or more of the one or more software packages used to provide the game cycle;

storing in the memory, for each game cycle provided by the wager gaming machine, the game history data determined for the provided game cycle and the package identification information determined for the provided game cycle, wherein the game history data for the provided game cycle is associated with the package identification information for the provided game cycle;

storing in the memory, for each game cycle, player information relating to the player of the wager gaming machine during each game cycle;

receiving, by the wager gaming machine, a request that a past game cycle be re-created on the wager gaming machine;

determining, by the processor and responsive to receiving the request, whether any of the one or more software packages indicated by the package identification information associated with the past game cycle are presently unavailable on the wager gaming machine;

when any of the one or more software packages indicated by the package identification information associated with the past game cycle are presently unavailable on the wager gaming machine, displaying, on a display of the gaming machine, textual information previously displayed during the past game cycle and requesting each presently unavailable software package to the wager gaming machine from at least one second and receiving said presently unavailable software packages;

creating, by the processor, a representation of the past game cycle using, at least in part, the one or more software packages indicated by the package identification information associated with the past game cycle and the game history data; and displaying, on the display of the gaming machine, the representation of the past game cycle and a visual representation of the player information relating to the player of the wager gaming machine during the past game cycle.

7. The method of claim 6, wherein the game history data at least includes game re-creation data produced by the one or more software packages and wherein the game history data also defines at least one outcome of the game cycle.

8. The method of claim 6, wherein each game cycle represents a single game play of a wagering game.

9. The method of claim 8, wherein at least one of the one or more game cycles is for a poker game and each of the at least one game cycle for the poker game includes dealing an initial card hand, one or more rounds of bets, and a determination of one or more winning card hands.

10. The method of claim 8, wherein at least one of the one or more game cycles is for a slot machine game and each of the at least one game cycle for the slot machine game includes an initial wager, a reel-spin, and a determination of at least one pay line outcome.

11. The method of claim 6, wherein the past game cycle is a particular game cycle identified via an input received by at least one input device.

12. The method of claim 11, the method further comprising:

when any of the one or more software packages indicated by the package identification information associated with the past game cycle are presently unavailable on the wager gaming machine and a designated input is received:

displaying at least some of the retrieved game history data in textual form; and displaying an indication of the retrieved package identification information in textual form.

13. The method of claim 12, wherein the displayed indication of the package identification information indicates the at least one of the one or more software packages indicated by the package identification information that are presently unavailable on the wager gaming machine and does not indicate any software packages indicated by the package identification information that are presently available on the wager gaming machine.

14. The method of claim 6, wherein the package identification information includes a file name.

15. The method of claim 6, wherein the package identification information includes a package name and a version.

16. The method of claim 6, wherein the package identification information includes a pointer to a particular record in an external database, wherein the particular record in the external database uniquely identifies a particular software package of the at least one of the one or more software packages currently unavailable on the wager gaming machine.

17. The method of claim 16, wherein the particular record in the external database also provides a pointer to a memory location in the at least one second memory where the particular software package is stored.

18. The method of claim 6, wherein the at least one second memory is a removable memory device temporarily communicatively connected with the wager gaming machine for the purposes of game cycle re-creation.

19. The method of claim 6, wherein the wager gaming machine is configured to communicate with a gaming server over a gaming network and the at least one second memory is located in the gaming server.

20. The method of claim 6, wherein the wager gaming machine is configured to communicate with multiple second wager gaming machines over a gaming network, the at least one second memory is distributed across the multiple second wager gaming machines, and the transferred one or more software packages are transferred from the second wager gaming machines to the wager gaming machine using a peer-to-peer protocol.

21. The method of claim 1, further comprising capturing an image of the player through a camera of the wager gaming machine, wherein the player information includes the image, and wherein displaying the visual representation includes displaying the image on the display.

22. The method of claim 1, wherein the player information includes biometric data.

23. The method of claim 22, wherein the biometric data includes a fingerprint, and wherein displaying the visual representation of the player information includes displaying a visual representation of the fingerprint on the display.

24. The method of claim 6, further comprising capturing an image of the player through a camera of the wager gaming machine, wherein the player information includes the image.

25. The method of claim 6, wherein the player information includes biometric data.

26. The method of claim 25, wherein the biometric data includes a fingerprint.

27. The method of claim 1, wherein the representation of the past game cycle is displayed on a first portion of the display, wherein the visual representation of the player information is displayed on a second portion of the display, and wherein the first portion of the display is different than the second portion of the display.

* * * * *